US005230574A

United States Patent [19]

Namekawa

[11] Patent Number: 5,230,574

[45] Date of Patent: Jul. 27, 1993

[54] RECORDING APPARATUS HAVING A COMPOUND MOVEMENT PRINT HEAD

[75] Inventor: Takumi Namekawa, Kanagawa, Japan

[73] Assignee: Sony Corporation, Japan

[21] Appl. No.: 745,236

[22] Filed: Aug. 14, 1991

[30] Foreign Application Priority Data

Aug. 24, 1990 [JP] Japan ..... 2-223280

[51] Int. Cl.[5] ..... B41J 2/32

[52] U.S. Cl. ..... 400/120; 400/225; 400/246

[58] Field of Search ..... 400/194, 195, 196, 196.1, 400/207, 208, 208.1, 225, 242, 246, 629, 642, 611, 613, 120, 120 HE

[56] References Cited

U.S. PATENT DOCUMENTS 4,917,513 4/1990 Takanashi et al. ..... 400/208
5,005,998 4/1991 Takanashi et al. ..... 400/246
5,087,926 2/1992 Wakui ..... 400/120

FOREIGN PATENT DOCUMENTS 46668 2/1987 Japan ..... 400/242
87368 4/1987 Japan ..... 400/208
97765 6/1987 Japan .
102648 6/1987 Japan .
151367 7/1987 Japan ..... 400/208
175947 9/1987 Japan .

*Primary Examiner*—Edgar S. Burr
*Assistant Examiner*—John S. Hilten
*Attorney, Agent, or Firm*—Ronald P. Kananen

[57] ABSTRACT

A recording apparatus in which a comparatively small spacing is required for automatic loading of transfer paper of a transfer paper and record paper cartridge. The recording apparatus comprises a spool feeding mechanism for feeding a supply spool from a transfer paper and record paper cartridge mounted in position in the recording apparatus to an opposite position with respect to a platen roller to effect loading of the transfer paper, a paper supplying mechanism for supplying a record paper sheet from within the cartridge to the platen roller, and a print head which is pressed against the platen roller with the record paper sheet and the transfer paper interposed therebetween. The print head is held, when loading of the transfer paper is being performed, at a position at which it is spaced from the platen roller by a distance sufficient to allow the supply spool to pass through the spacing, but is moved, after such loading of the transfer paper is completed, to another position at which the print head is opposed to the platen roller so that it may be pressed against the platen roller to effect intended recording.

11 Claims, 24 Drawing Sheets

RECORDING APPARATUS HAVING A COMPOUND MOVEMENT PRINT HEAD

BACKGROUND OF THE INVENTION

1. Field of the Invention

This invention relates generally to a novel recording apparatus, and particularly to a recording apparatus of the type wherein record paper and transfer paper on which ink such as a developer which develops a color when it is transferred to such record paper is carried are used and a print head is pressed against a platen roller with such record paper and transfer paper interposed therebetween to effect intended recording. More specifically, the present invention relates to a recording apparatus in which a transfer paper and record paper cartridge is used which includes a record paper accommodating section in which record paper sheets are accommodated and a transfer paper accommodating section in which a supply spool around which transfer paper of the type mentioned is wound and a take-up spool to which a leading end of the transfer paper is secured are accommodated.

2. Description of the Prior Art

Recording of a recording apparatus such as, for example, a printer is performed in most cases such that ink such as a developer carried on transfer paper is transferred to record paper by means of a print head. Generally, record paper is fed while it is held in contact with a platen roller in a wrapped around condition, and transfer paper is fed in synchronism with the record paper while the print head is pressed against the platen roller with the transfer paper and the record paper interposed therebetween. Further, such transfer paper assumes the form of an elongated web in most cases, and loading of transfer paper of the form mentioned in position into a recording apparatus is normally performed by mounting a supply spool on which transfer paper is wound and a take-up spool to which a leading end of the transfer paper is secured at predetermined respective mounting positions.

An exemplary one of conventional printers having such construction as described above is shown in FIGS. 20 and 21. Referring to FIGS. 20 and 21, the conventional printer shown is generally denoted at reference character a. The printer a includes a printer body b having a tray receiving section j, a cartridge receiving section k, and a printing section 1. A supply paper tray d in which a large number of photographic paper sheets c may be accommodated is mounted into the tray receiving section j of the printer body b to load the photographing paper sheets c in position into a paper supplying section of the printer body b. Meanwhile, an ink ribbon cartridge e is mounted into the cartridge receiving section k and includes a cartridge case f in which a supply spool h and a take-up spool i are accommodated for rotation around their respective axes. An ink ribbon g carrying thereon ink which develops a color when it is transferred to a transfer paper sheet c is wound around the supply spool h while a leading end of the ink ribbon g is secured to the take-up spool i. Thus, when the ink ribbon cartridge e is mounted into the cartridge receiving section k, the ink ribbon g is loaded in position into the printing section 1 of the printer body b. The printing section 1 includes a platen roller m and a print head n, and when the ink ribbon cartridge e is mounted in position into the cartridge receiving section k of the printer body b, a portion of the ink ribbon g therein is positioned such that it extends across the platen roller m in a direction perpendicular to an axis of the platen roller m. Meanwhile, the print head n has an end portion supported for pivotal motion on a shaft o and the other end portion to which a link mechanism p is connected. Thus, except when a printing operation is performed, the print head n is held at a standby position indicated by a solid line, that is, at a position in which it is opposed to the platen roller m in a spaced relationship by such a distance as will not interfere with movement of a mid portion of the ink ribbon cartridge e.

Then, when a printing instruction is received, a photographic paper sheet c is forwarded from the supply paper tray d and wrapped around the platen roller m, and then the printing head n is moved from its standby position by the link mechanism p to a contacting position indicated by an alternate long and two short dashes line in FIG. 21 at which a head portion q thereof is pressed against the platen roller m with the ink ribbon g and the photographing paper sheet c interposed therebetween. In this condition, the platen roller m is rotated around its axis to feed the photographing paper sheet c while the take-up spool i is rotated to feed the ink ribbon g in synchronism with the photographic paper sheet c, whereupon ink carried on the ink ribbon g is transferred to the photographic paper sheet c by the head portion q to effect intended printing.

Conventional recording apparatus such as the printer a described hereinabove have the following problems.

In particular, separate operations are required for loading of photographing paper sheets c and loading of an ink ribbon g, and besides such photographic paper sheets c must be accommodated in a supply paper tray d in advance. Thereupon, the photographic paper sheets c must be placed with print faces thereof directed in a predetermined direction after front and back faces thereof are confirmed. Accordingly, much cumbersome operation is required for preparations.

Further, record paper and transfer paper used in a recording apparatus of the type mentioned must match in type with each other, or else, either printing is impossible, or even if printing is possible, a print of required quality cannot be obtained. In this connection, since record paper and transfer paper used in a conventional recording apparatus are handled separately, there is a problem that record paper and transfer paper which do not match with each other may be used in error. Especially, if record paper sheets left unused are inadvertently mixed with record paper sheets of a different type when they are to be placed into custody, then when they are to be used for the next time, printing may take place while the record paper sheets may not match with transfer paper used then.

Thus, an investigation has been made to develop a new recording apparatus which is constructed to removably receive therein a single cartridge having a cartridge case in which a large number of record paper sheets and a supply spool on which transfer paper of a type matching with the record paper sheets is wound as well as a take-up spool to which a leading end of the transfer paper is secured are accommodated (such cartridge will be hereinafter referred to as transfer paper and record paper cartridge). The recording apparatus is further constructed such that one of the supply and take-up spools may be taken out from such transfer paper and record paper cartridge mounted in position in the recording apparatus and then moved to a position substantially opposite to the transfer paper and record paper cartridge with respect to the platen roller to load the transfer paper in position so that it may follow a predetermined route at the printing section.

With such recording apparatus, loading of record paper and transfer paper can be performed readily, and a mistake will not take place in matching between record paper and transfer paper nor in setting of front-back orientation of record paper.

Where such construction as described above is employed, however, in order to allow such movement of a spool as described above, a sufficiently great spacing is required between the platen roller and the print head so that they may not interfere with the movement of a spool, and consequently, the standby position of the print head must be set at a considerable distance from the platen roller, which will lead to a problem that the printer has an increased size as much. Especially, since such conventional print head is mounted for pivotal motion around a stationary axis between the standby position and the pressing position, also the radius of pivotal motion of the print head must be increased by a distance corresponding to a distance over which the distance between the print head at the standby position and the platen roller is increased. Consequently, the print head itself must be increased in size. Accordingly, a considerably great spacing must be prepared in order to allow intended movement of the print head.

SUMMARY OF THE INVENTION

It is an object of the present invention to provide a recording apparatus in which a cartridge in which record paper sheets and transfer paper are accommodated can be used and one of a supply spool and a take-up spool for the transfer paper can be automatically fed to a certain position to position a portion of the transfer paper between the supply spool and the take-up spool to cooperate with a platen roller.

It is another object of the present invention to provide a recording apparatus in which a cartridge in which record paper sheets and transfer paper are accommodated can be used and a comparatively small spacing is required for automatic feeding of one of a supply spool and a take-up spool for the transfer paper to a certain position to position a portion of the transfer paper between the supply spool and the take-up spool to cooperate with a platen roller.

In order to attain the objects, according to the present invention, there is provided a recording apparatus which comprises a platen roller, means for mounting in position into the recording apparatus a transfer paper and record paper cartridge which includes a record paper accommodating section in which record paper sheets are accommodated and a transfer paper accommodating section in which a supply spool around which transfer paper is wound and a take-up spool to which a leading end of the transfer paper is secured are accommodated, spool feeding means for taking out one of the supply spool and the take-up spool from the transfer paper and record paper cartridge mounted in position in the recording apparatus and feeding the one spool to an operative position substantially opposite to the transfer paper and record paper cartridge with respect to the platen roller to effect loading of the transfer paper so that a portion of the transfer paper which extends between the one spool and the other spool may be opposed to the platen, paper supplying means for taking out one of the record paper sheets from within the transfer paper and record paper cartridge and feeding the record paper sheet to the platen roller, a print head for being pressed against the platen roller with the record paper sheet and the transfer paper interposed therebetween, contacting means for pressing the print head against the platen roller, and head moving means for holding, when loading of the transfer paper is performed by the spool loading means, the print head at a first position at which the print head is spaced from the platen roller by a distance sufficient to allow the one spool to pass through the spacing to or from the operative position but moving, after such loading of the transfer paper is completed, the print head to a second position at which the print head is opposed to the platen roller so that it may be pressed against the platen roller by the contacting means.

With the recording apparatus, loading of the transfer paper can be performed without any trouble even if the position at which the print head is opposed to the platen roller is not set outside the spacing necessary for feeding of the spool. Accordingly, a recording apparatus of the same type can be minimized in dimension in a direction in which a print head and a platen roller is opposed to each other.

The above and other objects, features and advantages of the present invention will become apparent from the following description and the appended claims, taken in conjunction with the accompanying drawings in which like parts or elements are denoted by like reference characters.

DETAILED DESCRIPTION OF THE PREFERRED EMBODIMENT

Figure 1:
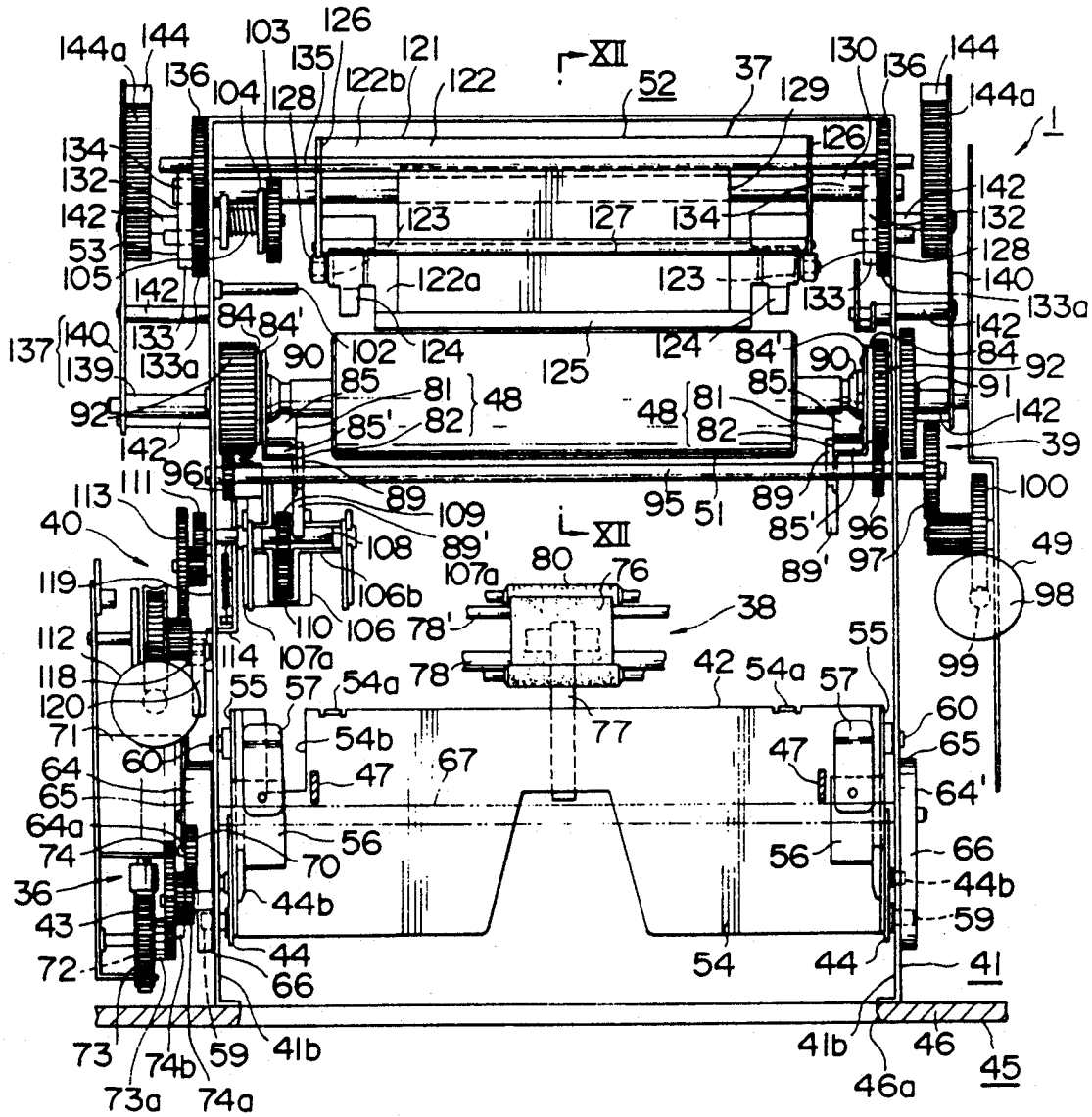
FIG. 1 is a plan view showing an entire mechanism of a video printer to which a recording apparatus of the present invention is applied.
Figure 2:
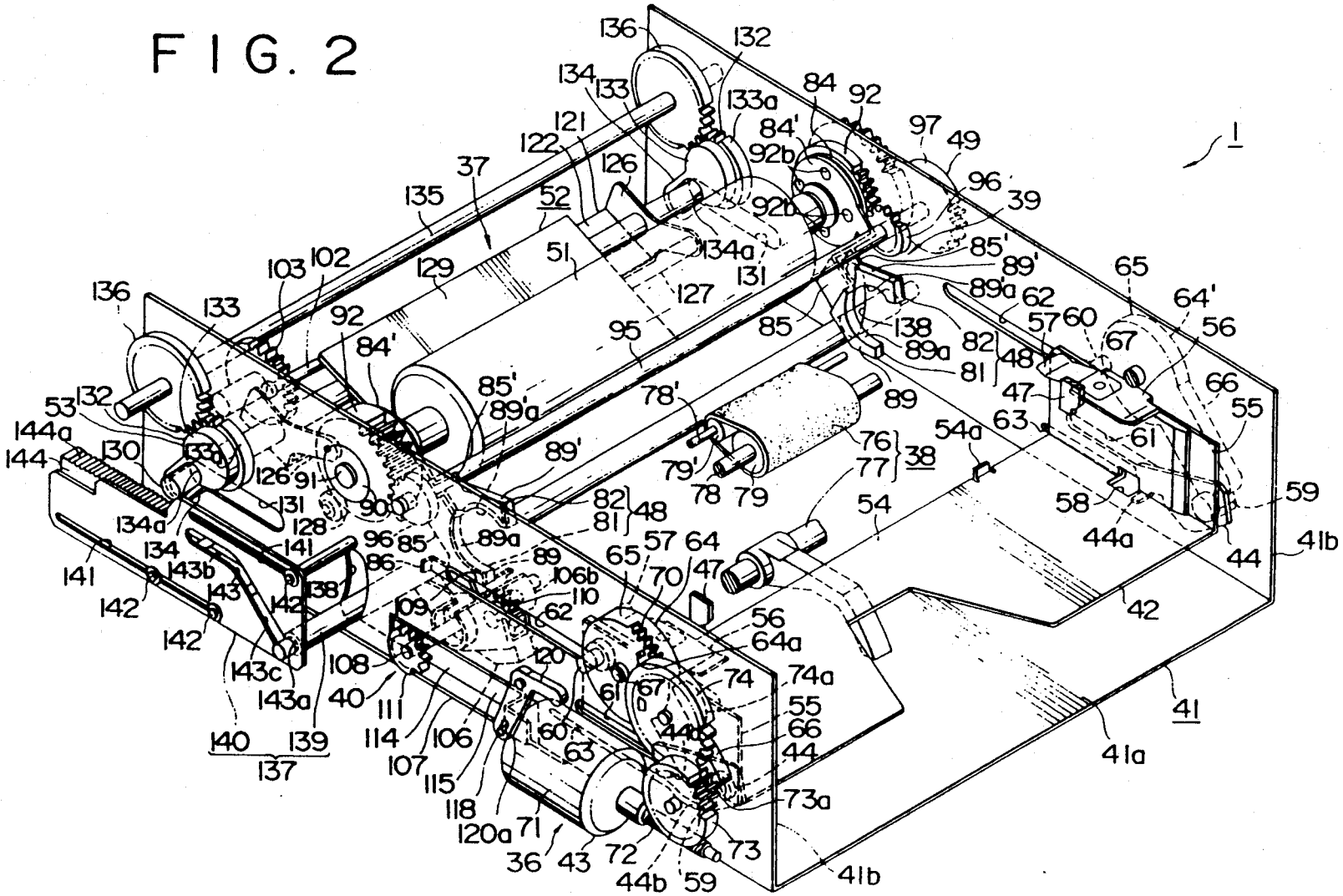
FIG. 2 is a perspective view of the video printer of FIG. 1.

Referring first to FIG. 1, there is shown a video printer to which a recording apparatus according to the present invention is applied. The video printer is generally denoted at 1 and prints using an ink ribbon and photograph paper cartridge in which both of an ink ribbon and photograph paper sheets are accommodated.

In order to facilitate understanding of the invention, such ink ribbon and photograph paper cartridge will be described first.

Referring to FIGS. 3 to 7, 9(A) to 9(D), and 13 to 19, such ink ribbon and photograph paper cartridge is shown and generally denoted at 2. The ink ribbon and photographic paper cartridge 2 includes a cartridge case 7 in which a photographic paper accommodating chamber and a spool accommodating section are formed. A large number of photographic paper sheets 3 can be accommodated in the photographic paper accommodating chamber of the ink ribbon and photographic paper cartridge 2 while a supply spool 5 around which an ink ribbon 4 in the form of a web is wound and a take-up spool 6 to which a leading end of the ink ribbon 4 is secured are supported in the spool accommodating section of the ink ribbon and photographic paper cartridge 2.

The photographic paper sheets 3 are placed one above another in a pile 8 and each has a rectangular profile in plan. One of front and rear faces of each of the photographic paper sheets 3 is formed as a print face which is chemically processed in advance so that it may react with ink carried on the ink ribbon 4 to develop a color.

The ink ribbon 4 is constituted from a base film 9 in the form of a web formed from a synthetic resin film and a large number of ink layers 10 made of a sublimable ink and formed on a face of the base film 9. Each of the ink layers 10 has a rectangular shape in plan a little smaller than the outer profile of a photographic paper sheet 3, and the ink layers 10 are disposed in a predetermined spaced relationship from each other along a longitudinal direction of the base film 9 such that each three successive ones thereof make a set and have different pigments which individually develop, when they are thermally transferred to a photographic paper sheet 3, three different colors of yellow, magenta and cyan. The ink ribbon 4 has a predetermined number of sets of such three successive ink layers 10 equal to the number of photographic paper sheets 3 of the pile 8 initially accommodated in the photographic paper accommodating section of the ink ribbon and photographic paper cartridge 2. In all of the sets of the ink layers 10, the three colors mentioned above are disposed in the same order.

Figure 13:
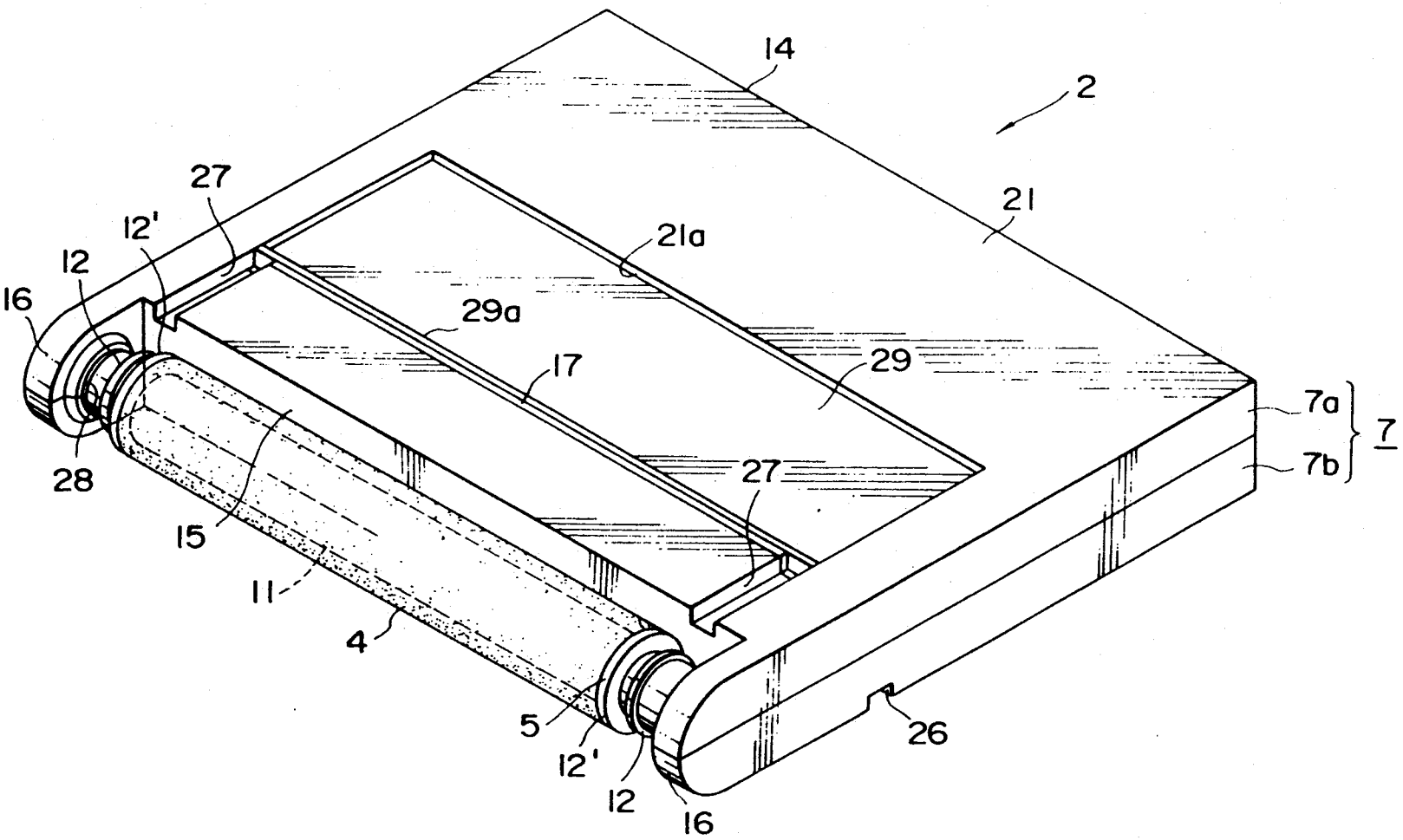
FIG. 13 is a perspective view showing a form of ink ribbon and photographic paper cartridge for use with the video printer of FIG. 1 with a supply spool accommodated in an ink ribbon accommodating section.

Each of the supply spool 5 and the take-up spool 6 is formed as a unitary member from a synthetic resin material and includes a cylindrical portion 11, a pair of outer flanges 12 formed adjacent the opposite ends of the cylindrical portion 11, and a pair of inner flanges 12' formed at locations of the cylindrical portion 11 spaced a little inwardly from the outer flanges 12. A gear 13 is formed at the right end of the cylindrical portion 11. Here, the obliquely rightwardly downward direction in FIG. 13 is referred to as right or right side while the opposite obliquely leftwardly upward direction is referred to as left or left side. Further, the obliquely leftwardly downward direction in FIG. 13 is referred to as front or front side while the opposite obliquely rightwardly upward direction is referred to as rear or rear side. In the following description, any direction regarding the ink ribbon and photographic paper cartridge 2 depends upon the definition described just above.

The ink ribbon 4 is wound around a portion of the cylindrical portion 11 of the supply spool 5 between the inner flanges 12' such that the ink layers 10 thereon may be directed to the cylindrical portion 11, and a leading end of the the ink ribbon 4 is secured to a portion of the cylindrical portion 11 of the take-up spool 6 between the inner flanges 12'.

Referring now to FIGS. 3 to 6 and 13 to 19, the cartridge case 7 is constituted from a pair of upper and lower halves **7*a* and 7*b* coupled integrally to each other and includes a main portion 14 having a profile like a rectangular box elongated in the leftward and rightward direction as viewed in a thicknesswise direction, a pair of hollow projected portions 16 extending forwardly in parallel to each other from the opposite left and right ends of a front wall 15 of the main portion 14 and each having a horizontally laid down U-shaped profile as viewed in a lateral direction, a partition wall 17 located in the main portion 14 and having a rearwardly open channel-shaped profile as viewed from above, and a pair of spool supporting walls 18 located forwardly of the partition wall 17. The remaining portion 19 of the inside of the main portion 14 of the cartridge case 7 except a front end portion and the opposite left and right end portions serves as the photographic paper accommodating chamber mentioned hereinabove, and another portion 20 of the inside of the main portion 14 forwardly of the photographic paper accommodating chamber 19** serves as the spool accommodating chamber also mentioned hereinabove.

The spool supporting walls 18 are disposed adjacent the opposite left and right ends of the spool accommodating chamber 20 and each has a circular supporting hole **18*a*** formed therein.

The cartridge case 7 has a top plate 21 having a paper supply opening **21*a* formed at a portion thereof opposing to a front portion of the photographic paper accommodating chamber 19**.

The cartridge case 7 further has a bottom plate 22 which is so shaped that a portion thereof opposing to a front portion of the photographic paper accommodating chamber 19 is a little higher than the other portion thereof, and a forwardly and rearwardly elongated lever insertion hole 23 is formed at a substantially central location of the higher portion of the bottom plate 22 in the leftward and rightward direction while a pair of slits 24 are formed adjacent the opposite left and right ends of a rear end portion of the higher portion of the bottom plate 22.

A gear insertion recess 25 is formed in the bottom plate 22 in an opposing relationship to a right end portion of the spool accommodating chamber 20 while a pair of engaging recesses 26 are formed at the opposite left and right end portions of a bottom wall of the bottom plate 22. A pair of forwardly and rearwardly extending grooves 27 are formed at the left and right end portions of a portion of a top wall of the top plate 21 forwardly of the paper supply opening 21*a* such that front ends thereof reach the front wall 15 while rear ends thereof are opened to the paper supply opening 21*a*.

A circular hole 28 is formed in each of opposing walls of the projected portions 16 of the cartridge case 7.

A leftwardly and rightwardly elongated ink ribbon exit 15*a* is formed between a portion of a lower end portion of the front wall 15 of the cartridge case 7 between the projected portions 16 and a front end edge of the bottom plate 22.

Referring now to FIGS. 4, 5 and 13 to 18, a lid member 29 is provided to open or close the paper supply opening 21*a* and has a major portion in the form of a flat plate having a little greater than the paper supply opening 21*a*. The lid member 29 is disposed in a thin spacing between the top plate 21 and the opposite side portions of the partition wall 17 and supported for sliding movement in the forward and backward directions on upper edges of the opposite side portions of the partition wall 17. The lid member 29 is normally urged forwardly by a pair of tension coil springs 30 extending between the lid member 29 and the cartridge case 7 such that it is kept, when it is not acted upon by an external rearwardly acting force, at a closing position at which it closes the paper supplying opening 21*a* with a front end edge 29*a* thereof abutted with a front side face of the paper supplying opening 21*a* as shown in FIG. 13.

Figure 14:
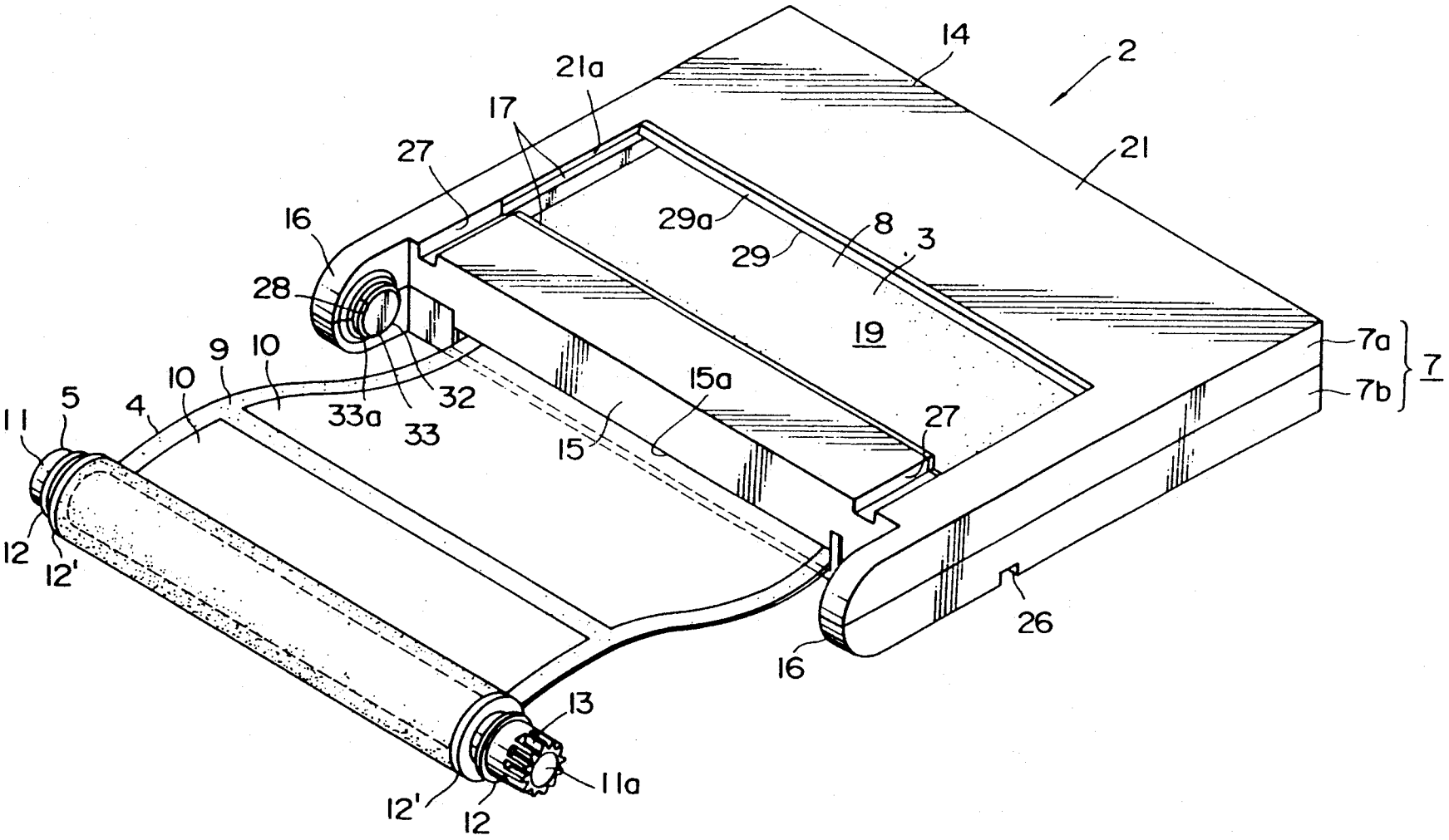
FIG. 14 is a perspective view of the ink ribbon and photographic paper cartridge of FIG. 13 from which the supply spool is taken out.
Figure 15:
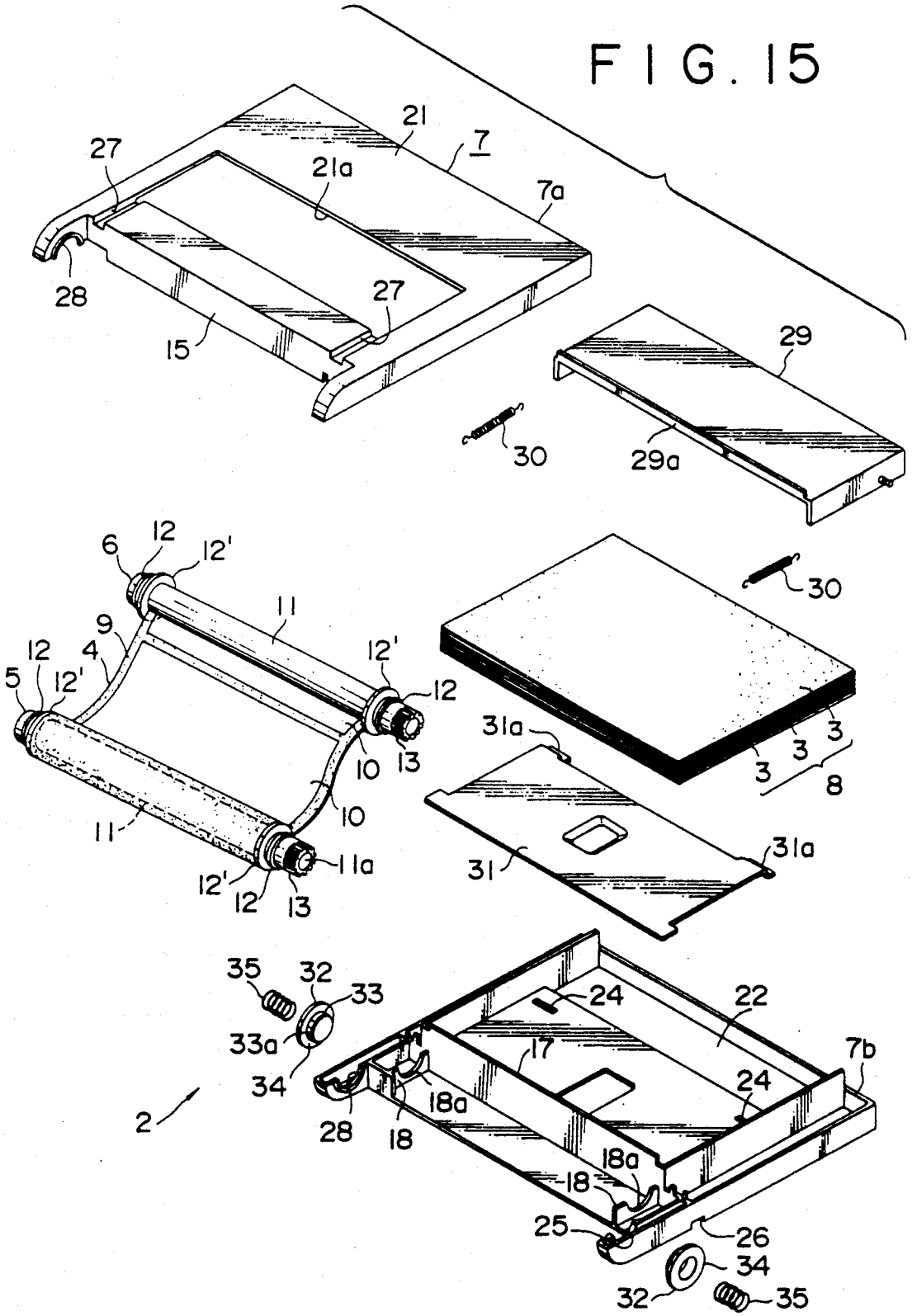
FIG. 15 is a fragmentary perspective view of the ink ribbon and photographic paper cartridge of FIG. 13.
Figure 16:
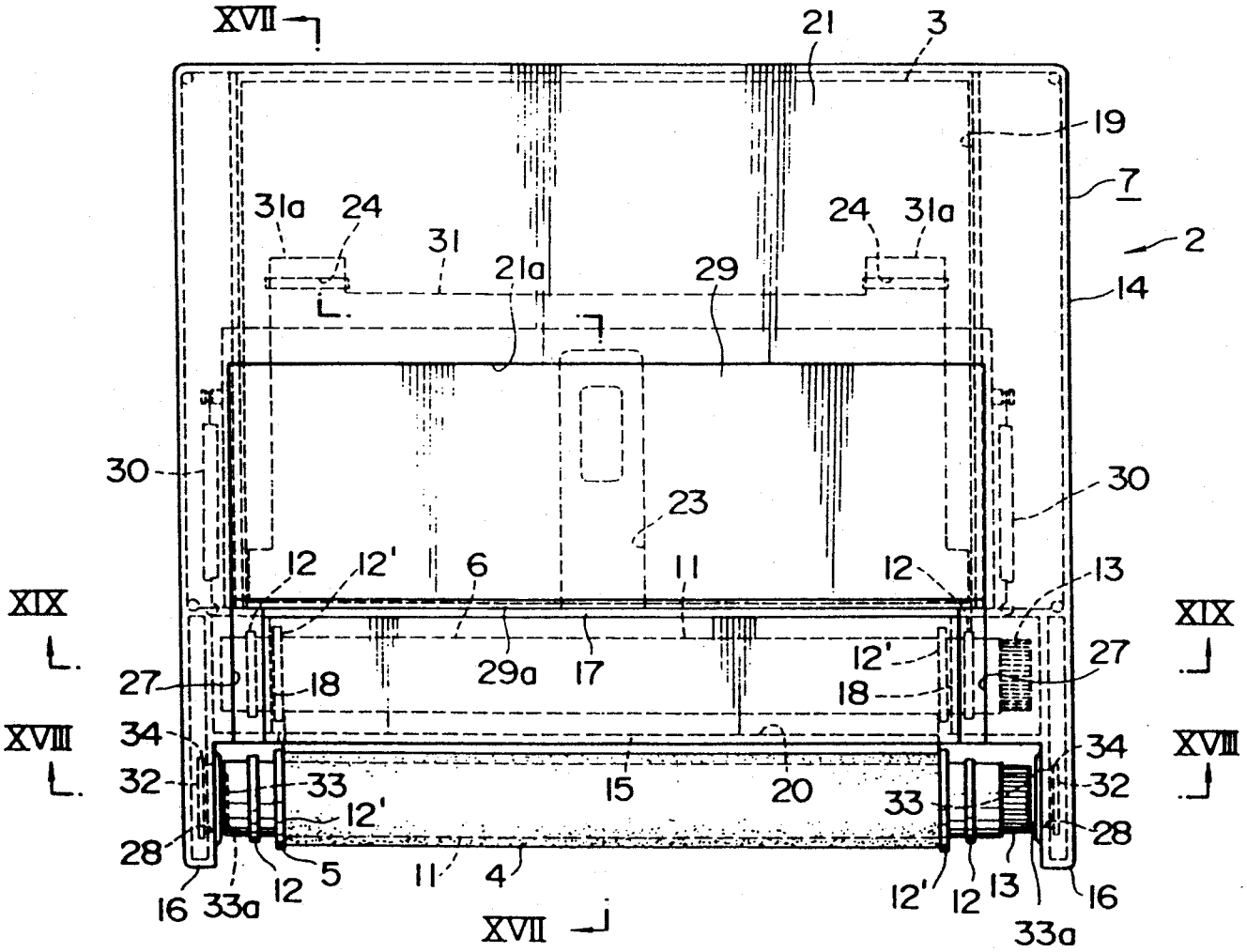
FIG. 16 is a plan view of the ink ribbon and photographic paper cartridge of FIG. 13.

It is to be noted that, when the ink ribbon and photographic paper cartridge 2 is to be mounted in position into the video printer 1, the lid member 29 is moved to an opening position shown in FIG. 14, that is, a position at which it opens the paper supplying opening 21*a*.

A photographic paper pushing up plate 31 has a pair of hinge pieces 31*a* formed at the opposite left and right ends of a rear end thereof. Each of the hinge pieces 31*a* has a substantially L-shape as viewed from the right thereof. The hinge pieces 31*a* of the photographic paper pushing up plate 31 are received for pivotal motion in the slits 24 formed in the bottom plate 22 of the cartridge case 7 to support the photographic paper pushing up plate 31 for pivotal motion substantially in upward and downward directions on a bottom face of the photographic paper accommodating chamber 19 provided by the bottom plate 22 of the cartridge case 7.

The supply spool 5 is removably supported by a pair of spool holders 32. Each of the spool holders 32 is formed as a unitary member including a substantially cylindrical holding portion 33 having a smaller axial length relative to its diameter and closed at an axial end face thereof, and a flange 34 extending radially outwardly from an outer periphery of the other end of the holding portion 33. A substantially half portion 33*a* of the holding portion 33 of each of the spool holders 32 remote from the flange 34 is tapered such that the diameter thereof decreases toward the end thereof, and the diameter of the half portion 33*a* at the end is a little smaller than an inner diameter of the opposite ends of an inner bore 11*a* of the cylindrical portion 11 of the supply spool 5.

The spool holders 32 of such construction are fitted, at the holding portions 33 thereof, for sliding movement in the holes 28 formed in the projected portions 16 of the cartridge cage 7 from the inner sides of the projected portions 16 and are normally urged by a pair of compression coil sprints 35 disposed between interior end faces of the holding portions 33 and mutually remote inner side ends of the projected portions 16 in the opposite directions to decrease the distance therebetween. Movement of the spool holders 32 in such directions is stopped by the flanges 34 thereof abutting with edge portions of inner side openings of the holes 28 of the projected portions 16 of the cartridge case 7, and in such stopped condition, the entire tapered portions 33*a* of the holding portions 33 thereof are projected outwardly from the holes 28.

Figure 17:
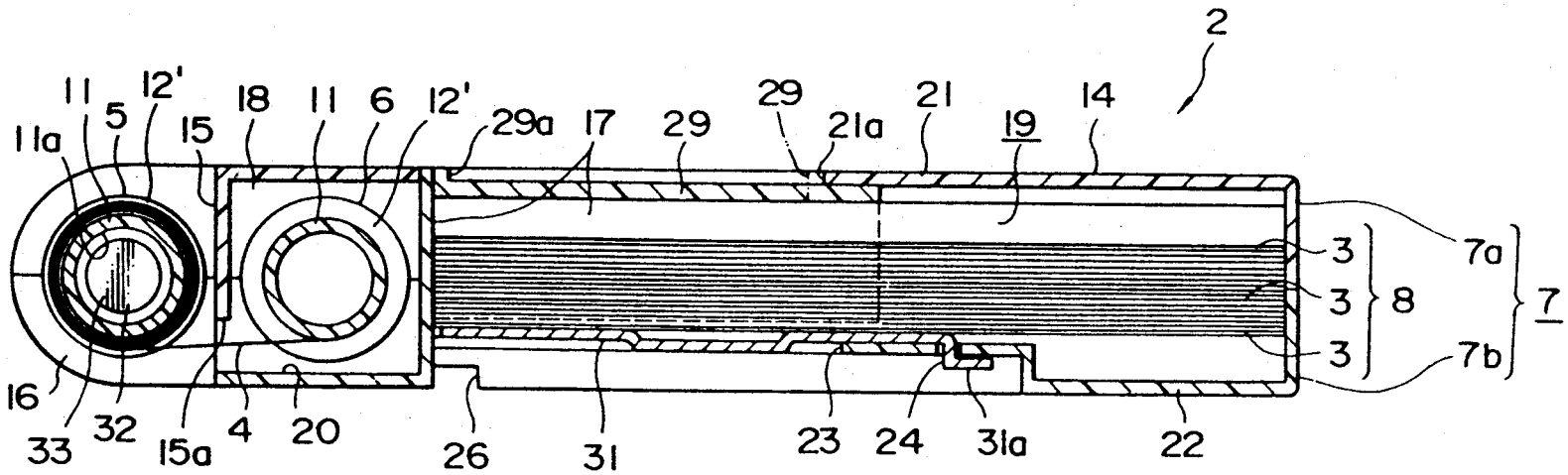
FIG. 17 is an enlarged sectional view taken along line XVII—XVII of FIG. 16.
Figure 18:
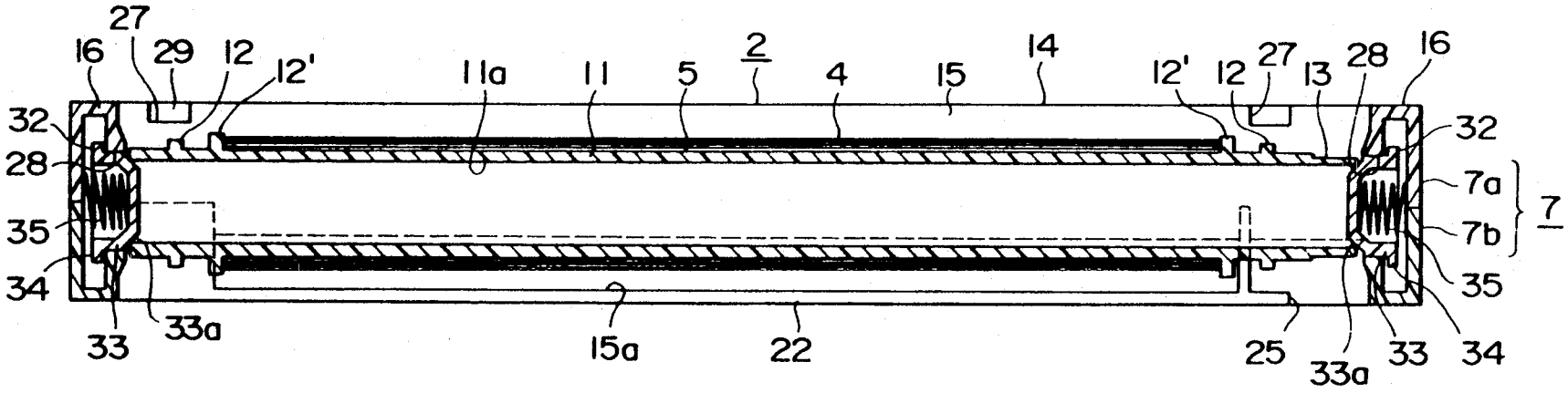
FIG. 18 is an enlarged sectional view taken along line XVIII—XVIII of FIG. 16.
Figure 19:
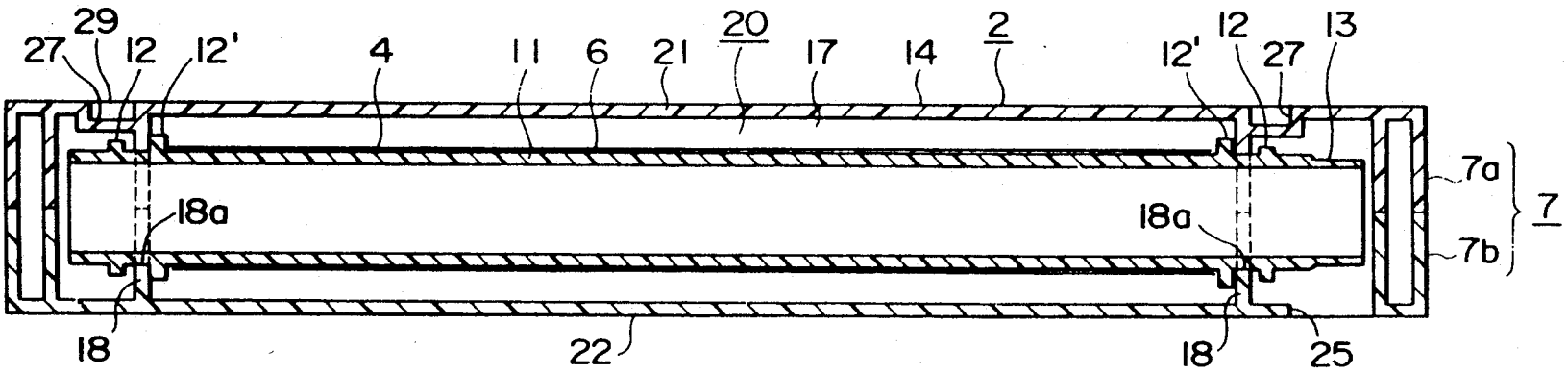
FIG. 19 is an enlarged sectional view taken along line XIX—XIX of FIG. 16.
Figure 20:
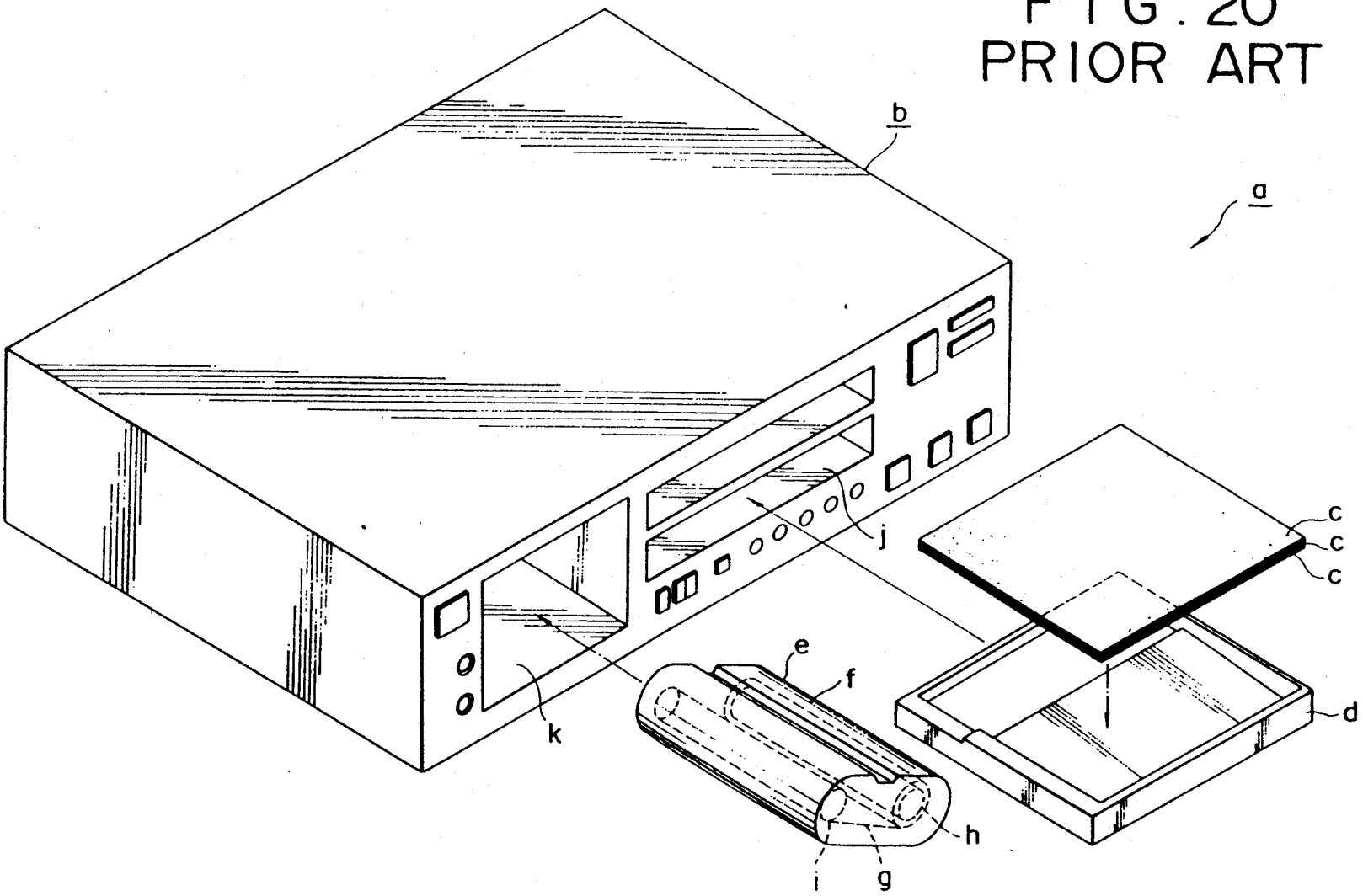
FIG. 20 PRIOR ART
FIG. 20 is a perspective view of an exemplary conventional printer showing a printer body and photographic paper sheets and an ink ribbon cartridge for use with the printer body.
Figure 21:
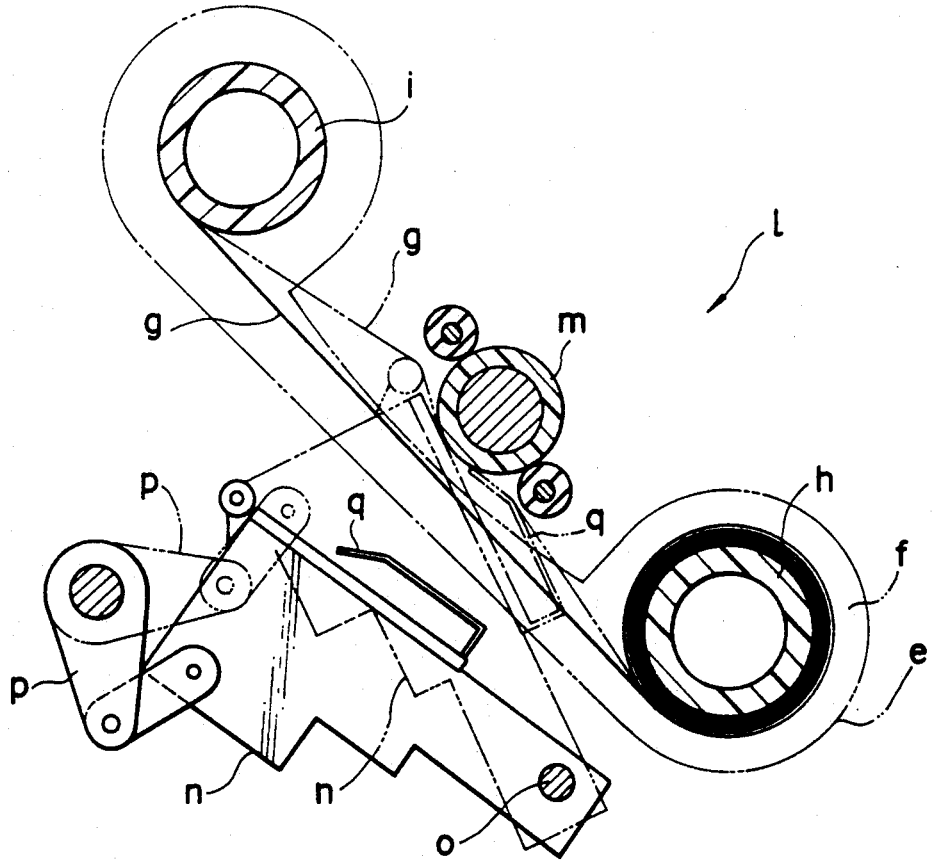
FIG. 21 PRIOR ART
FIG. 21 is an enlarged front elevational view, partly broken, showing a printing section of the printer of FIG. 20.

Referring now to FIGS. 17 to 19, the photographic paper sheet pile 8 is accommodated in the photographic paper accommodating chamber 19 such that it may be placed on the photographic paper pushing up plate 31 in predetermined orientation.

Meanwhile, the take-up spool 6 is accommodated in the spool accommodating chamber 20 in such a condition that portions of the cylindrical portion 11 between the left-hand side inner and outer flanges 12' and 12 and between the right-hand side inner and outer flanges 12' and 12 are supported for rotation in the supporting holes 18*a* formed in the spool supporting walls 18.

It is to be noted that the gear 13 of the take-up spool 6 is exposed downwardly through the gear insertion recess 25 formed in the bottom plate 22 while a portion of the ink ribbon 4 extending from the take-up spool 6 is extracted outwardly of the main portion 14 through the ink ribbon exit 15*a* in the front wall 15 of the cartridge case 7.

Then, as the tapered portions 33*a* of the spool holders 32 are inserted into the opposite end portions of the inner bore 11*a* of the cylindrical portion 11 of the supply spool 5, the supply spool 5 is supported by the projected portions 16 of the cartridge case 7. In particular, if the opposite end portions of the cylindrical portion 11 of the supply spool 5 are pressed laterally against outer peripheries of the tapered portions 33*a* of the spool holders 32, then the spool holders 32 are yieldably retracted once such that they are pushed into the projected portions 16 and then, after the ends of the tapered portions 33 coincide with the opposite ends of the inner bore 11*a* of the cylindrical portion 11, they are projected so that they approach each other. Consequently, the tapered portions 33*a* of the spool holders 32 are fitted in the opposite end portions of the inner bore 11*a* of the cylindrical portion 11 of the supply spool 5.

It is to be noted that a portion of the ink ribbon 4 on the leading end side having a certain length is formed as a leader portion on which no such ink layer 10 as described hereinabove is formed, and the spools 5 and 6 are placed in position into the cartridge case 7 after such leader portion of the ink ribbon 4 is wrapped around the take-up spool 6.

The ink ribbon and photographic paper cartridge 2 of such construction as described above is mounted in position into the video printer 1 while the supply spool 5 is held in the cartridge case 7, and movement of the lid member 29 to its opening position, loading of the ink ribbon 4 after removal of the supply spool 5 from the cartridge case 7 and so forth are all performed by mechanisms the video printer 1 has.

Accordingly, since loading of the photographic paper sheets 3 and the ink ribbon 4 in position into the video printer 1 is completed only by mounting the ink ribbon and photographic paper cartridge 2 in position into the video printer 1, operation is very simple, and further, since there is no need of touching the photographic paper sheets 3 or the ink ribbon 4 with hand, there is no possibility that a photographic paper sheet 3 or the ink ribbon 4 may be soiled or damaged. Besides, since photographic paper sheets and an applicable ink ribbon are always handled together with each other, the matching property between them will not be mistaken. Besides, if some of the photographic paper sheets 3 are left unused, then only the entire ink ribbon and photographic paper cartridge 2 must be placed into custody, and accordingly, management thereof is easy and there is no possibility that the photographic paper sheets 3 may be mixed with some other photographic paper sheets of a different type.

Referring now to FIGS. 1 to 5, there is shown a mechanical section of the video printer 1. The video printer 1 includes a cartridge mounting mechanism 36 for mounting and ejecting an ink ribbon and photographic paper cartridge 2 into and from a predetermined location of the video printer 1, a printing station 37 for printing on a photographic paper sheet 3, a paper supplying mechanism 38 for supplying a photographic paper sheet 3 to the printing station 37, a spool feeding mechanism 39 for taking out the supply spool 5 from the ink ribbon and photographic paper cartridge 2 mounted in position in the video printer 1 and feeding the thus taken out supply spool 5 to a predetermined position to load the ink ribbon 4 of the ink ribbon and photographic paper cartridge 2 in position into the video printer 1, and an ink ribbon feeding mechanism 40 for rotating the take-up spool 6 in the ink ribbon and photographic paper cartridge 2 to feed the ink ribbon 4.

The cartridge mounting mechanism 36 includes a cartridge holder 42 supported on a support frame 41 for movement in forward and rearward directions and adapted to removably receive an ink ribbon and photographic paper cartridge 2 in position therein. Here, the downward direction in FIG. 1 is referred to as front or front side while the opposite upward direction is referred as rear or rear side, and besides the leftward direction in FIG. 1 is referred to as left or left side while the opposite rightward direction is referred to as right or right side. Any direction regarding the video printer 1 in the following description depends upon the definition given just above. The cartridge mounting mechanism 36 further includes a moving mechanism 43 for moving the cartridge holder 42, and a pair of arresting levers 44 for securing the ink ribbon and photographic paper cartridge 2 mounted in position in the cartridge holder 42 to the cartridge holder 42. Insertion or removal of an ink ribbon and photographic paper cartridge 42 into or from the cartridge holder 42 is performed while the cartridge holder 42 is at its ejecting position shown in FIG. 3, that is, at a position wherein it is located rearwardly adjacent a cartridge mounting opening 46*a* formed in a front wall 46 of an outer housing 45 of the video printer 1. Thus, when an ink ribbon and photographic paper cartridge 2 is inserted into the cartridge holder 42, the cartridge holder 42 is initially moved rearwardly by pressing force from the ink ribbon and photographic paper cartridge 2, and while the cartridge holder 42 is moved over a predetermined distance, the arresting levers 44 are engaged with the engaging recesses 26 formed on the cartridge case 7 to secure the cartridge case 7 to the cartridge holder 42 and then the moving mechanism 43 is rendered operative. Consequently, the cartridge holder 42 is moved by the moving mechanism 43 to move the ink ribbon and photographic paper cartridge 2 to its mounted position shown in FIG. 4, that is, to a position wherein a rear face of the cartridge case 7 of the ink ribbon and photographic paper cartridge 2 closes the cartridge mounting opening 46*a*.

Then, while the ink ribbon and photographic paper cartridge 2 is moved toward its mounted position, the lid member 29 thereof is moved to its open position by a pair of lid opening members 47.

The spool feeding mechanism 39 includes a pair of left and right pivotal chucking levers 48, a lever pivoting mechanism 49 for pivoting the chucking levers 48, and a locking lever 50 supported on one of the chucking levers 48. When an ink ribbon and photographic paper cartridge 2 is mounted to its mounted position, the chucking levers 48 receive the supply spool 5 thereon and are then pivoted by the lever pivoting mechanism 49 to take out the supply spool 5 from the cartridge case 7 and move the same to its loaded position shown in FIG. 4 to load the ink ribbon 4 in the cartridge case 7 in position into the printing station 37. Thereupon, inadvertent rotation of the supply spool 5 is prevented by the locking lever 50.

The printing station 37 includes a platen roller 51 adapted to rotate around its axis with a photographic paper 3 wrapped therearound, a print head 52 of the thermal type, a head feeding mechanism 53 for feeding the print head 52, and a mechanism for pressing the print head 52 against the platen roller 51. The print head 52 assumes its retracted position shown in FIG. 3 until after feeding of the supply spool 5 to its loaded position is completed so that it may not interfere with such feeding of the supply spool 5.

After a printing operation is started, a photographic paper sheet 3 is forwarded from within the cartridge case 7 to the printing station 37 by the paper supplying mechanism 38 and then wrapped around the platen roller 51. Then, the print head 52 is moved upwardly past its advanced position indicated by a solid line in FIG. 12 to its pressing position shown in FIG. 5 at which a head portion thereof is pressed against the platen roller 51 with the ink ribbon 4 and the photographic paper sheet 3 interposed therebetween. In this condition, the platen roller 51 is rotated while the ink ribbon 4 is fed in a synchronized relationship, thereby to transfer ink carried on the ink ribbon 4 to the photographic paper sheet 3 to effect intended printing.

It is to be noted that the supporting frame 41 is a member serving as a base for the various mechanisms described above and includes a bottom plate 41*a* and a pair of side plates (hereinafter referred to as "supporting walls") 41*b* extending upwardly in parallel to each other from the opposite left and right side edges of the bottom plate 41*a*. The supporting frame 41 is secured in the outer casing 45.

Referring now to FIGS. 1 to 6, the cartridge holder 42 includes a bottom plate 54 in the form of a flat plate elongated in the leftward and rightward direction and having a leftward and rightward dimension greater than the leftward and rightward dimension of the cartridge case 7, a pair of side plate 55 extending upwardly from the opposite left and right side edges of the bottom plate 54, a pair of comparatively small top plates 56 extending inwardly toward each other from mid portions of upper edges of the side plates 55, a pair of cartridge holders 57 each formed from a leaf spring member and secured to the top plates 56. A pair of short pressure receiving lugs 54*a* are formed upwardly at locations of a rear side edge of the bottom plate 54 of the cartridge holder 42 adjacent the opposite left and right ends, and a forwardly and rearwardly elongated recess 54*b* is formed at a location of the bottom plate 54 adjacent the rear end of the rear side edge. Further, a pair of fitting openings 58 are formed in and extend between the bottom plate 54 and the side plates 55 at mid locations in the forward and rearward direction.

A pair of first pins 59 are mounted horizontally at front ends of lower end portions of outer side faces of the side plates 55, and a pair of second guide pins 60 are mounted horizontally at rear ends of upper end portions of the outer side faces of the side plate 55. The first and second guide pins 59 and 60 are held in sliding engagement in two pairs of guide slots 61 and 62 formed at front half portions of the supporting walls 41*b* of the supporting frame 41 such that they extend in parallel to each other in the forward and rearward direction. The cartridge holder 42 is thus supported for movement in the forward and rearward directions at the same height as the cartridge mounting opening 46*a*.

The arresting levers 44 are supported at front end portions thereof for pivotal motion substantially in upward and downward directions on the first guide pins 59 and have engaging portions 44*a* formed at pivoting end portions thereof such that they extend inwardly toward each other and present loci of pivotal motion which pass the holes 58 of the cartridge holder 42. The arresting levers 44 further have guide pins 44*b* mounted thereon such that they extend outwardly away from each other, and the guide pins 44*b* are held in sliding engagement in cam slots 63 formed in the supporting walls 41*b* of the supporting frame 41.

According, the arresting levers 44 are moved in the forward or rearward direction integrally with the cartridge holder 42, but the positions thereof in the vertical direction are controlled by the cam slots 63 held in engagement with the guide pins 44*b* thereon.

The moving mechanism 43 for moving the cartridge holder 42 includes a pair of left and right pivotal levers 64 and 64', and a motor 71, a motion transmitting gear mechanism and so forth for pivoting the pivotal levers 64 and 64' in a synchronized relationship with each other.

Each of the pivotal levers 64 and 64' is formed as a unitary member including a base portion 65 in the form of a disk and an arm 66 extending radially outwardly from an outer periphery of the base portion 65. The pivotal levers 64 and 64' are individually secured at central portions of the base portions 65 thereof to the opposite end portions of a shaft 67 supported for rotation on the supporting walls 41*b* of the supporting frame 41. The arm 66 of each of the pivotal levers 64 and 64' has an engaging hole 68 formed at an about half portion adjacent an end thereof and extending in a longitudinal direction thereof, and further has a recess 68*a* formed at a front half portion thereof forwardly in a contiguous relationship to the engaging hole 68. The first guide pins 59 of the cartridge holder 42 are held at end portions thereof in sliding engagement in the engaging holes 68 of the arms 66 of the pivotal levers 64 and 64'.

A pair of torsion springs 69 are disposed in concave portions not shown formed on opposing faces of the pivotal levers 64 and 64' and each has an end portion held in resilient contact substantially from forwardly with the corresponding first guide pin 59 so that the first guide pins 59 are normally pressed against rear side faces of the engaging holes 68 of the pivotal levers 64 and 64'.

Accordingly, if the pivotal levers 64 and 64' are pivoted in this condition, then the first guide pins 59 are pushed substantially in the forward or rearward direction in accordance with the direction of such pivotal motion of the pivotal levers 64 and 64', and consequently, the cartridge holder 42 is moved in the forward or rearward direction.

The left-hand side pivotal lever 64 has a gear portion 70 formed on an outer periphery of the base portion 65 thereof over a range of about 180 degrees in central angle.

A worm 72 of the three spiral type is connected to a rotary shaft of the motor 71, and a worm wheel 73 is held in meshing engagement with the worm 72. A speed reducing gear 74 is held in meshing engagement with a small gear portion 73*a* formed integrally on the worm wheel 73, and a small gear portion 74*a* formed integrally thereon is held in meshing engagement with the gear portion 70 of the pivotal lever 64. Accordingly, when the motor 71 rotates, the pivotal levers 64 and 64' are pivoted around an axis of the shaft 67.

It is to be noted that, when the cartridge holder 42 is to be moved rearwardly, the motor 71 is rotated forwardly to rotate the worm wheel 73 in the clockwise direction as viewed from the left, but on the contrary when the cartridge 42 is to be moved forwardly, the motor 71 is rotated reversely to rotate the worm wheel 73 in the counterclockwise direction.

Figure 3:
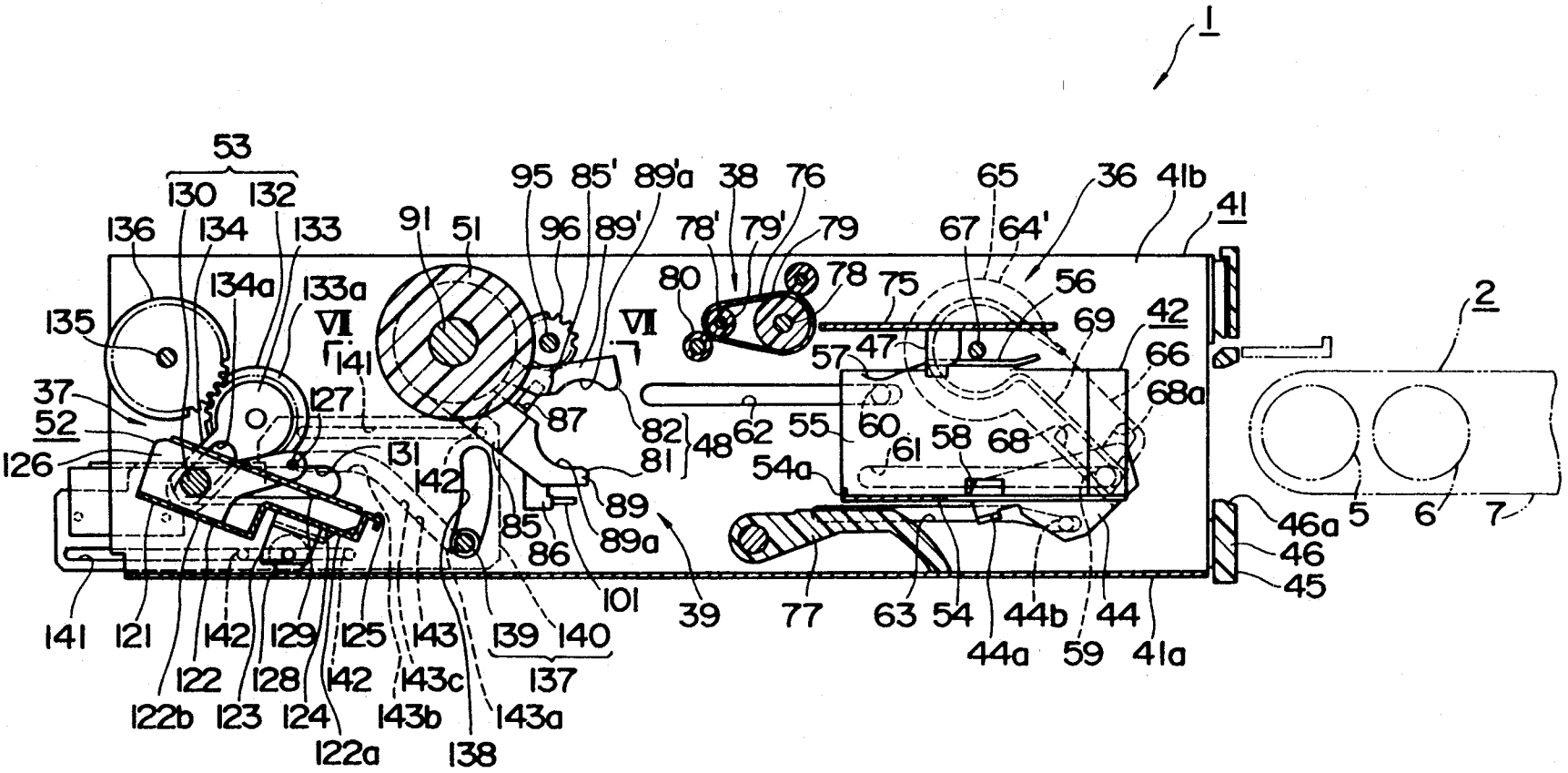
FIG. 3 is a vertical sectional view taken along a center line of the video printer of FIG. 1 in an initial condition.

In an initial condition of the video printer 1, the pivotal levers 64 and 64' are at their initial position at which the arms 66 thereof extend substantially forwardly downwards from the base portions 65 thereof as seen in FIG. 3. In this condition, the cartridge holder 42 is at its ejecting position while the guide pins 44*b* of the arresting levers 44 are positioned at the front end portions of the cam slots 63 so that the arresting levers 44 are held at their disengaged position at which the engaging portions 44*a* thereof are positioned a little lower than the bottom plate 54 of the cartridge holder 42.

Mounting of an ink ribbon and photographic paper cartridge 2 in position into the video printer 1 is performed by inserting an ink ribbon and photographic paper cartridge 2 into the cartridge holder 42 and then pushing the cartridge holder 42 rearwardly over some distance with the ink ribbon and photographic paper cartridge 2.

In particular, when the ink ribbon and photographic paper cartridge 2 is inserted into the cartridge holder 42, first the front wall of the major portion 14 of the cartridge case 7 is contacted with the pressure receiving lugs 54*a* formed on the bottom plate 54 of the cartridge holder 42 and pushes the same rearwardly. Consequently, the cartridge holder 42 is moved rearwardly. Then, while the cartridge holder 42 is moved over a predetermined distance in this manner, the guide pins 44*b* on the arresting levers 44 are displaced upwardly by the cam slots 63 of the supporting frame 41 to pivot the arresting levers 44 upwardly so that the engaging pawls 44*a* of the arresting levers 44 are engaged with the engaging recesses 26 of the cartridge case 7. Consequently, the cartridge case 7 is fixed in position relative to the cartridge holder 42.

Immediately after then, the motor 71 is rotated forwardly so that the pivotal levers 64 and 64' are pivoted in the clockwise direction. When the pivotal levers 64 and 64' are pivoted about 90 degrees in the clockwise direction from their initial positions, the guide pins 59 and 60 of the cartridge holder 42 are abutted with the rear ends of the guide slots 61 and 62 in which they are held in individual engagement (refer to FIG. 4). Consequently, the cartridge holder 42 is prevented from further moving in the rearward direction. In other words, the cartridge holder 42 comes to its mounting position.

Such forward rotation of the motor 71 is stopped when the speed reducing gear 74 is rotated over some angle in the counterclockwise direction after the condition described just above is reached. During such additional rotation, the gear portion 70 of the left-hand side pivotal lever 64 is brought out of meshing engagement with the speed reducing gear 74, whereafter the pivotal levers 64 and 64' are further pivoted in the clockwise direction as a pressure receiving projection 64*a* (refer to FIG. 6) mounted on an outer face of the base portion 65 of the left-hand side pivotal lever 64 is pushed by an inclined portion of a pressing cam 74*b* (refer to FIG. 6) provided on the speed reducing gear 74.

Figure 4:
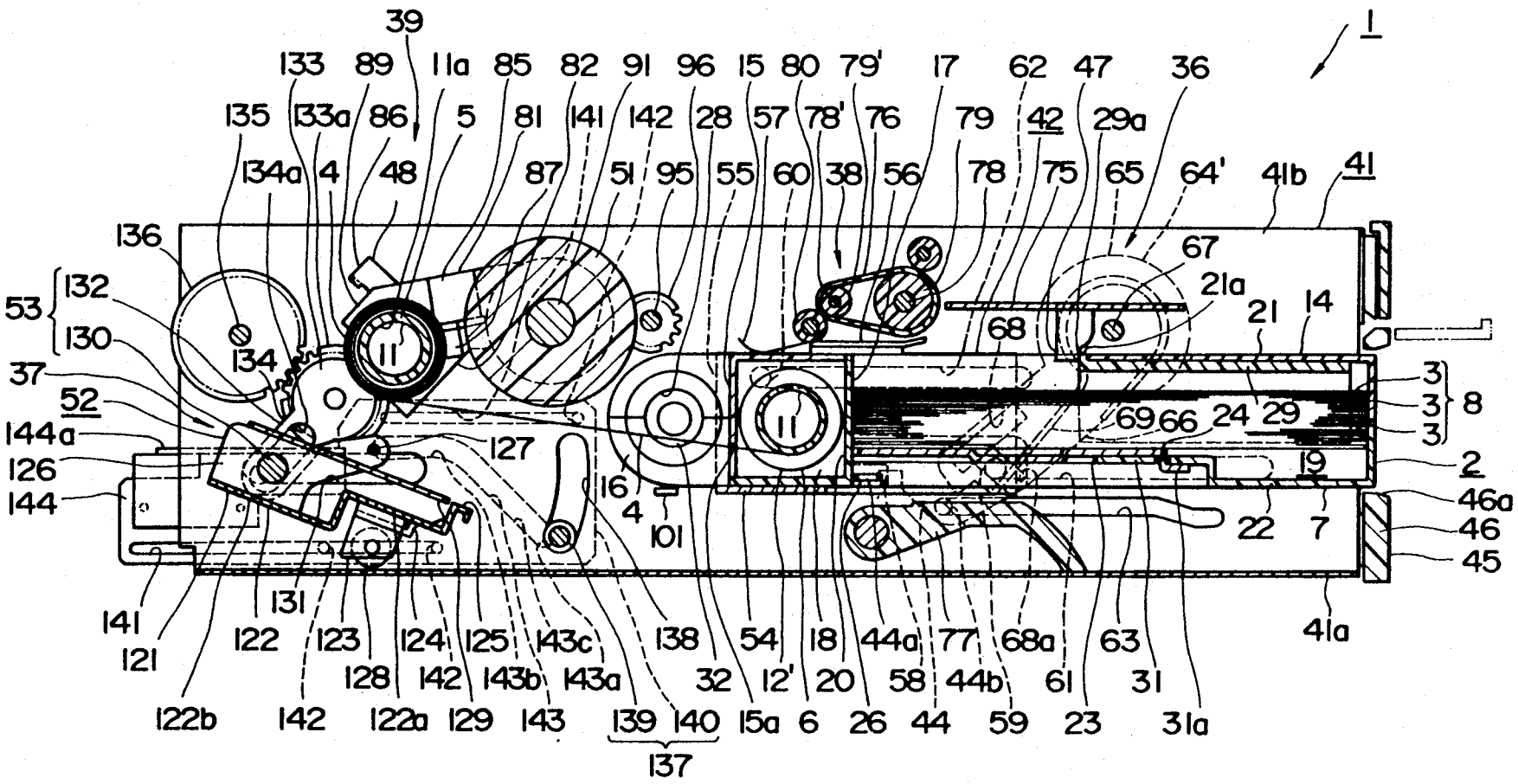
FIG. 4 is a similar view but showing the video printer of FIG. 1 in a home position.
Figure 6:
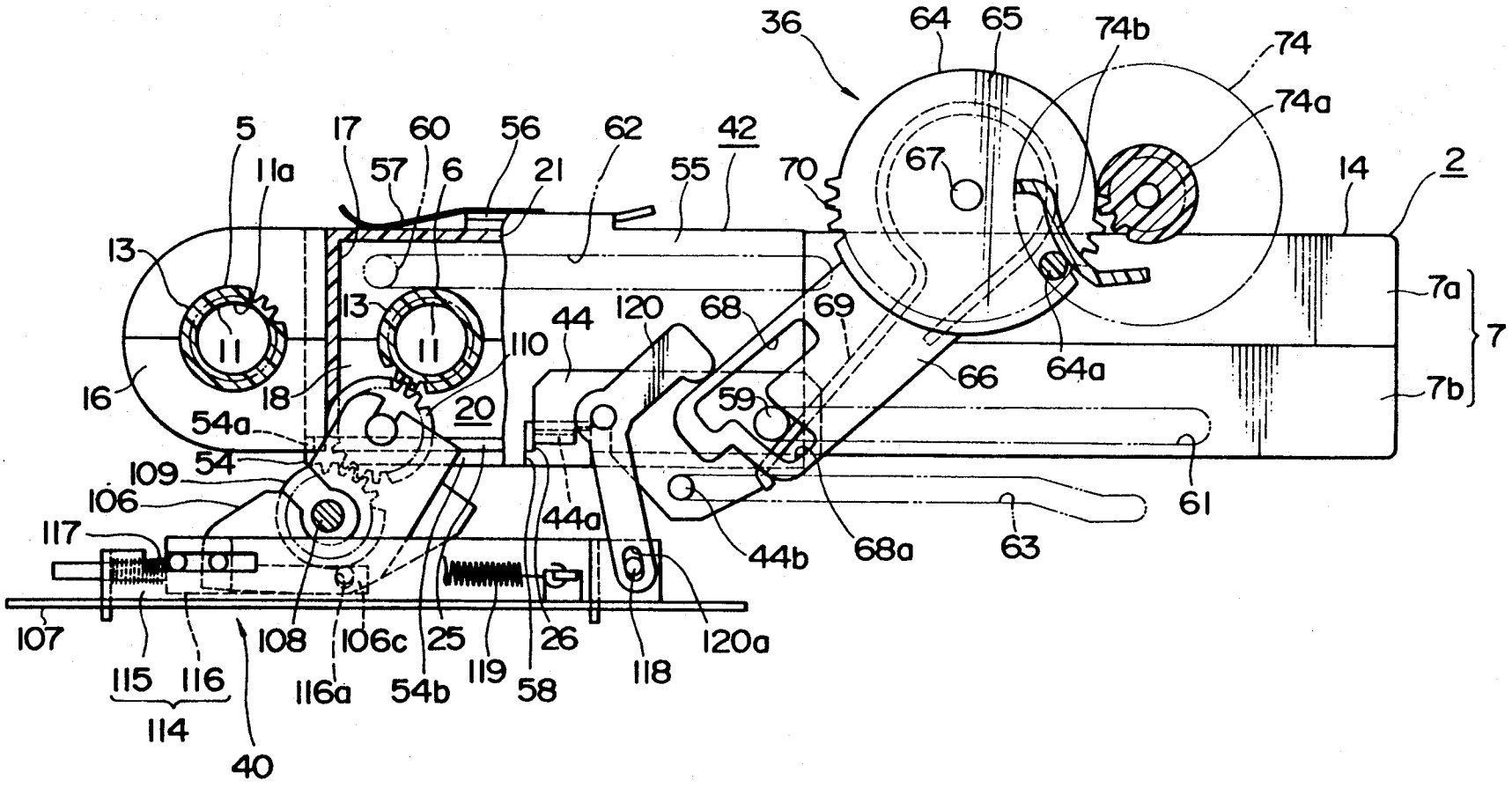
FIG. 6 is an enlarged side elevational view, partly broken, of part of the video printer of FIG. 1 showing an ink ribbon and photographic paper cartridge fixed in position.

Accordingly, the pivotal levers 64 and 64' are pivoted over some angle in the clockwise direction after the cartridge holder 42 reaches its mounting position, and consequently, at a point of time when pivotal motion of the pivotal levers 64 and 64' is stopped, the rear side faces of the engaging holes 68 of the pivotal levers 64 and 64' are spaced rearwardly from the first guide pins 59 of the cartridge holder 42 while the first guide pins 59 are positioned in the recesses 68*a* of the engaging holes 68 as shown in FIGS. 4 and 6. Consequently, the urging force of the torsion springs 69 acts as a force to press the first guide pins 59 against the rear end edges of the guide slots 61, and accordingly, the cartridge holder 42 is resiliently retained at the mounting position.

Mounting of the ink ribbon and photographic paper cartridge 2 proceeds in such a manner as described above. The mounted condition is maintained as the pressure receiving projection 64*a* of the left-hand side pivotal lever 64 contacts with an arcuate portion of the pressing cam 74*b* of the speed reducing gear 74 as seen in FIG. 6.

It is to be noted that, if an instruction to eject the ink ribbon and photographic paper cartridge 2 is received in this condition, then the motor 71 is rotated reversely so that the pivotal levers 64 and 64' are pivoted in the counterclockwise direction thereby to move the cartridge holder 42 to its ejecting position while the arresting levers 44 are returned to their disengaging positions immediately before the cartridge holder 42 reaches the ejecting position.

Figure 5:
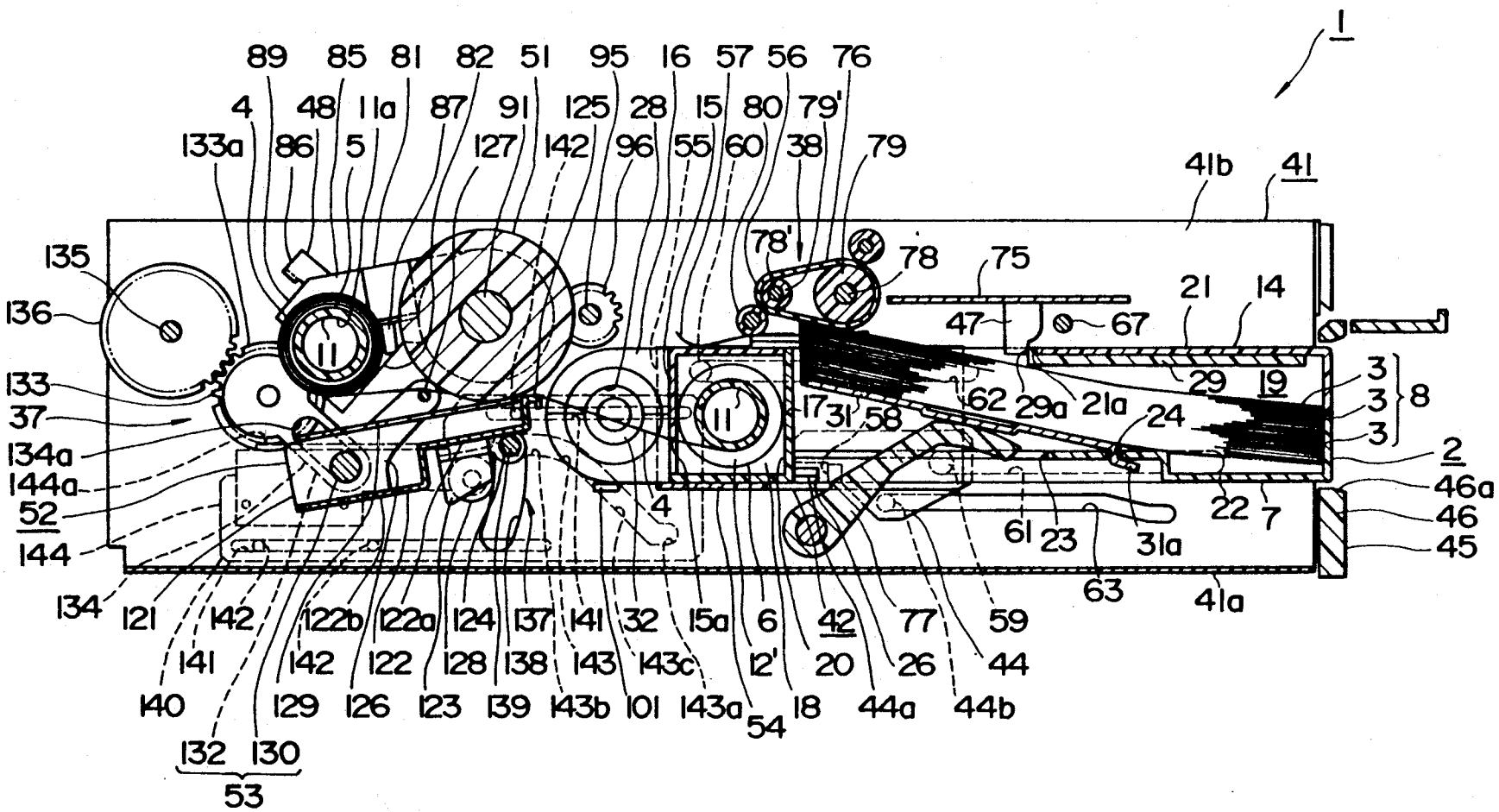
FIG. 5 is a similar view but showing the video printer of FIG. 1 in a printing condition.

Referring particularly to FIGS. 3 to 5, a discharge paper guide plate 75 is disposed in a horizontal posture at a location at a front half portion of the inside of the supporting frame 41 adjacent an upper end. A pair of lid opening members 47 each in the form of a comparatively small plate are provided downwardly at locations adjacent the opposite left and right ends of the discharge paper guide plate 75.

Referring again to FIGS. 1 to 6, when an ink ribbon and photographic paper cartridge 2 is inserted into the cartridge holder 42, lower end portions of the lid opening members 47 are introduced relatively into the grooves 27 of the cartridge case 7 so that the cartridge case 7 begins to push the cartridge holder 42 to move rearwardly while substantially at the same time the lower end portions of the lid opening members 47 are contacted with the opposite left and right end portions of the front end portion 29*a* of the lid member 29 to push the lid member 29 to move relatively forwardly toward its opening position. Then, substantially at the same time when the ink ribbon and photographic paper cartridge 2 reaches its mounted position, the lid member 29 reaches its opening position thereby to open the paper supplying opening 21*a* of the cartridge case 7.

Then, if the ink ribbon and photographic paper cartridge 2 is moved forwardly in the video printer 1 in this condition, then the pushing operation of the lid opening members 47 upon the lid member 29 is cancelled, and consequently, the lid member 29 is moved toward its lid closing position by the urging force of the tension springs 30. Then, substantially at the same time when the cartridge holder 42 reaches its ejecting position, the lid member 29 reaches its lid closing position.

Thus, at a point of time when it is intended to take out the ink ribbon and photographic paper cartridge 2 from the cartridge holder 42, the paper supplying opening 21*a* is in a closed condition.

The paper supplying mechanism 38 includes a paper supplying belt 76 and a pushing up lever 77.

The paper supplying belt 76 extends in an endless condition between and around a pair of rollers 79 and 79' secured to rotary shafts 78 and 78' supported for rotation on the supporting walls 41*b* of the supporting frame 41 such that, when one of the rotary shafts 78 and 78' is rotated by a motor not shown, the paper supplying belt 76 is circulated by the same. The paper supplying belt 76 is disposed proximately above the paper supplying opening 21*a* of an ink ribbon and photographic paper cartridge 2 at the mounted position.

The pushing up lever 77 is elongated in the forward and rearward direction and has a substantially horizontally laid down J-shaped profile as viewed from a side. The pushing up lever 77 is disposed for upward and downward pivotal motion at a location below the photographic paper accommodating chamber 19 for an ink ribbon and photographic paper cartridge 2 at its mounted position.

Thus, if a paper supplying instruction is received when an ink ribbon and photographic paper cartridge 2 is at the mounted position, then the paper supplying belt 76 is circulated and the pushing up lever 77 is pivoted in the counterclockwise direction as viewed from the left side. During such pivotal motion of the pushing up lever 77, a front half portion thereof passes through the lever insertion hole 23 formed in the bottom plate 22 of the cartridge case 7 and is projected into the photographic paper accommodating chamber 19 so that the pivoting end thereof is contacted with and pushes the photographic paper pushing up plate 31 to move upwardly.

Consequently, the photographic paper pushing up plate 31 is pivoted upwardly to push up the photographic paper pile 8, whereupon a front end portion of an uppermost one of the photographic paper sheets 3 of the photographic paper pile 8 is pressed from below against the paper supplying belt 75. As a result, the uppermost photographic paper sheet 3 is drawn out from the photographic paper accommodating chamber 19 by the paper supplying belt 76 and a follower roller 80 which is held in contact with and is rotated by the paper supplying belt 76. The photographic paper sheet 3 thus drawn out is fed along a paper guide not shown and wrapped around the platen roller 51.

Referring now to FIGS. 1 to 5 and 7 to 9(D), each of the chucking levers 48 includes a pair of opposing pivotal elements 81 and 82 and a tension spring 83 extending between the pivotal elements 81 and 82.

Figure 8:
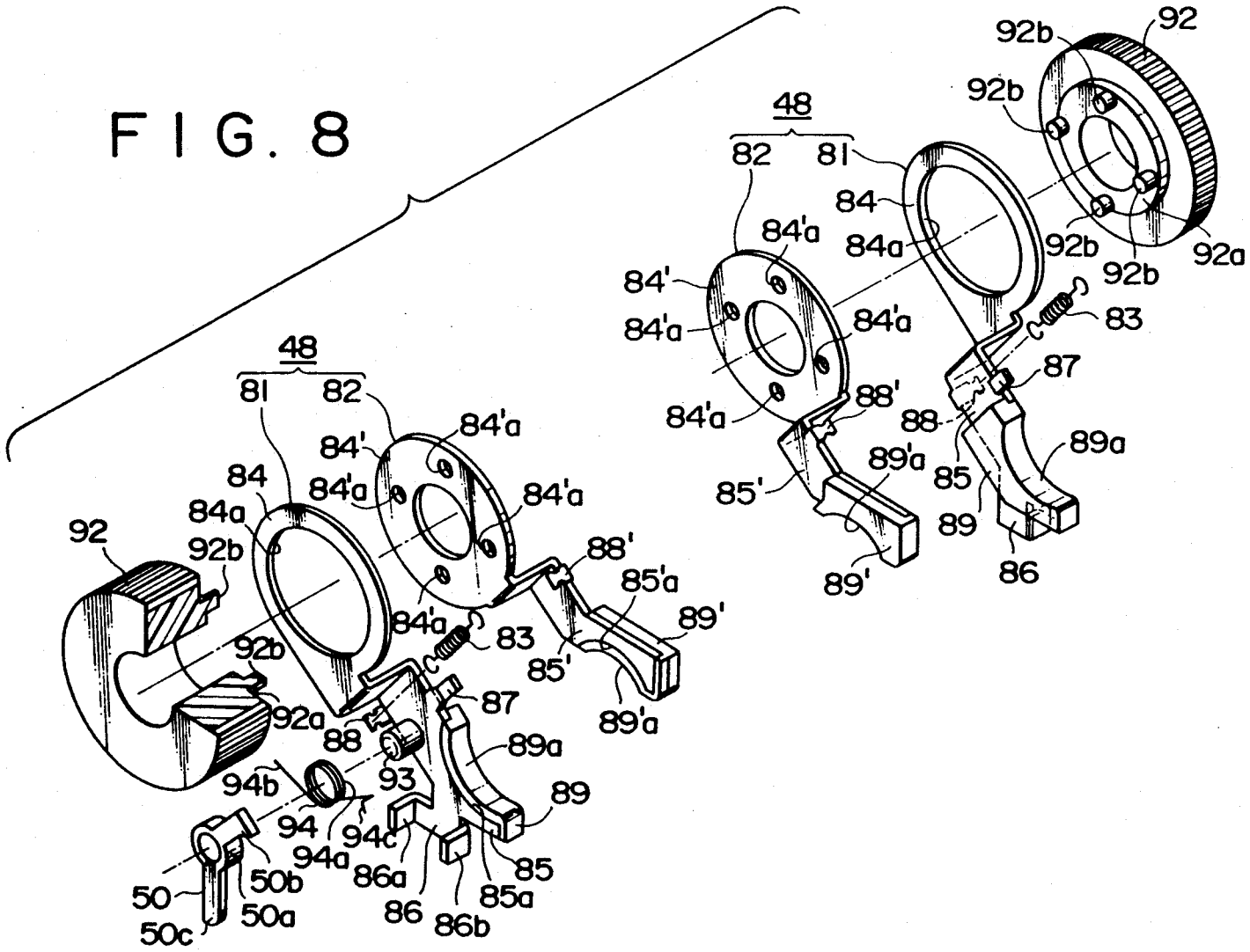
FIG. 8 is an enlarged fragmentary perspective view showing spool feeding means of the video printer of FIG. 1.

The pivotal element 81 of each of the chucking levers 48 is positioned below the other pivotal element 82 when the chucking lever 48 is at its standby position shown in FIG. 3. The pivotal element 81 will thus be hereinafter referred to as first pivotal element while the other pivotal element 82 will be hereinafter referred to as second pivotal element. The first pivotal element 81 has a base portion 84 having a substantially annular ring-like profile as viewed from the left or right, an arm 85 extending tangentially from an outer periphery of the base portion 84 as viewed from a side, a stopper portion 86, an abutting lug 87 and a spring anchor 88 which extend laterally from the arm 85, and a protective plate 89 secured to the arm 85. The arm 85 extends inwardly from the base portion 84 such that it presents a substantially L-shape as viewed in a direction perpendicular to an axis of the base portion 84 and is further bent laterally radially outwardly so that it extends in parallel to the base portion 84. The arm 85 has an arcuate recess 85*a* (only that one of the left-hand side pivotal element 82 is shown in FIG. 8) formed over a most part on the pivoting end side of a side edge of the parallel portion thereof. The abutting lug 87 extends upwardly from a location of the parallel portion of the arm 85 adjacent a base end such that it may present a substantially L-shape as viewed in a direction in which the arm 85 extends while the spring anchor 88 extends laterally outwardly from a base end portion of the other edge of the parallel portion of the arm 85. Meanwhile, the stopper portion 86 extends downwardly from a location adjacent the pivoting end of the arm 85. The protective plates 89 are secured to side faces of the arms 85 of the pivotal elements 81 opposing to each other and each has a spool holding portion 89*a* formed arcuately thereon in such a manner as to fringe the arcuate recess 85*a* of the arm 85.

It is to be noted that the stopper portion 86 of the left-hand side first pivotal element 81 when viewed from above in a condition wherein the chucking levers 48 are at their standby position has a channel-shaped profile opened substantially in the leftward direction while the right-hand side first pivotal element 81 is formed such that the stopper portion 86 thereof presents a substantially L-shaped profile.

The second pivotal element 82 of each of the chucking levers 48 has a base portion 84' having a substantially annular ring-like profile as viewed from the left or right, an arm 85' extending radially outwardly from an outer periphery of the base portion 84' as viewed from a side, a spring anchor 88' extending laterally from the arm 85', and a protective plate 89' mounted on the arm 85'. The arm 85' extends inwardly from the base portion 84' such that it presents a substantially L-shape as viewed in a direction perpendicular to an axis of the base portion 84' and is further bent laterally radially outwardly so that it extends in parallel to the base portion 84' similarly as the arm 85 of each of the first pivotal elements 81. The arm 85' has an arcuate recess 85'*a* (only that one of the left-hand side pivotal element 82' is shown in FIG. 8) formed at a location on the pivoting end side of a side edge of the parallel portion thereof adjacent the corresponding first pivotal element 81. The spring anchor 88' extends laterally outwardly from a base end portion of the other edge of the parallel portion of the arm 85'. Meanwhile, the protective plates 89' are secured to side faces of the arms 85' of the second pivotal elements 82 opposing to each other and each has a spool holding portion 89'*a* formed arcuately thereon in such a manner as to fringe the arcuate recess 85'*a* of the arm 85'. Four mounting holes 84'*a* are formed in a circumferentially equidistantly spaced relationship in the base portion 84' of the second pivotal element 82 of each of the chucking levers 48.

A substantially cylindrical bearing member 90 is provided inwardly at a location of each of the supporting walls 41*b* of the supporting frame 41 adjacent an upper end a little displaced from the center in the forward and rearward direction. A rotary shaft 91 to which the platen roller 51 is secured is supported at the opposite end portions thereof for rotation by the bearing members 90.

A lever pivoting gear 92 in the form of a comparatively thick spur gear is supported for rotation on each of the bearing members 90. Annular projections 92*a* are formed on opposing end faces of the lever pivoting gears 92, and four pins 92*b* extend axially inwardly from each of opposing faces of the annular projections 92*a*.

The base portions 84 of the first pivotal elements 81 are fitted for rotation around the annular projections 92*a* of the lever pivoting gears 92 while the pins 92*b* of the lever pivoting gears 92 are received in the mounting holes 84'*a* of the base portions 84 of the second pivotal elements 82 and are caulked at ends thereof to secure the second pivotal elements 82 to the respective lever pivoting gears 92.

Consequently, the first and second pivotal elements 81 and 82 are supported on the lever pivoting gears 92 in such a condition that the base portions 84 and 84' thereof are positioned on a common axis while the arms 85 and 85' of the first and second pivotal elements 81 and 82 are opposed to each other around the axis of the base portions 84 and 84'.

A tension spring 83 extends between the spring anchor 88 of each of the first pivotal elements 81 and the spring anchor 88' of the corresponding second pivotal element 82 so that the first pivotal element 81 is urged in the counterclockwise direction as viewed from the left while the second pivotal element 82 is urged in the clockwise direction.

Thus, since the first and second pivotal elements 81 and 82 are urged in a direction to approach each other, while no external force is applied to move the first and second pivotal elements 81 and 82 away from each other, portions of the abutting lugs 87 of the first pivotal element 81 opposing to the second pivotal elements 82 and opposing side edges of the arms 85' of the second pivotal elements 82 are contacted with each other, and in this condition (which will be hereinafter referred to as closed condition), the spool holding portion 89*a* of each of the first pivotal elements 81 and the spool holding portion 89'*a* of the corresponding second pivotal element 82 are positioned on a circle in a contiguous relationship to each other. Further, in the closed condition, the first and second pivotal elements 81 and 82 are pivoted in an integral relationship with each other.

Figure 7:
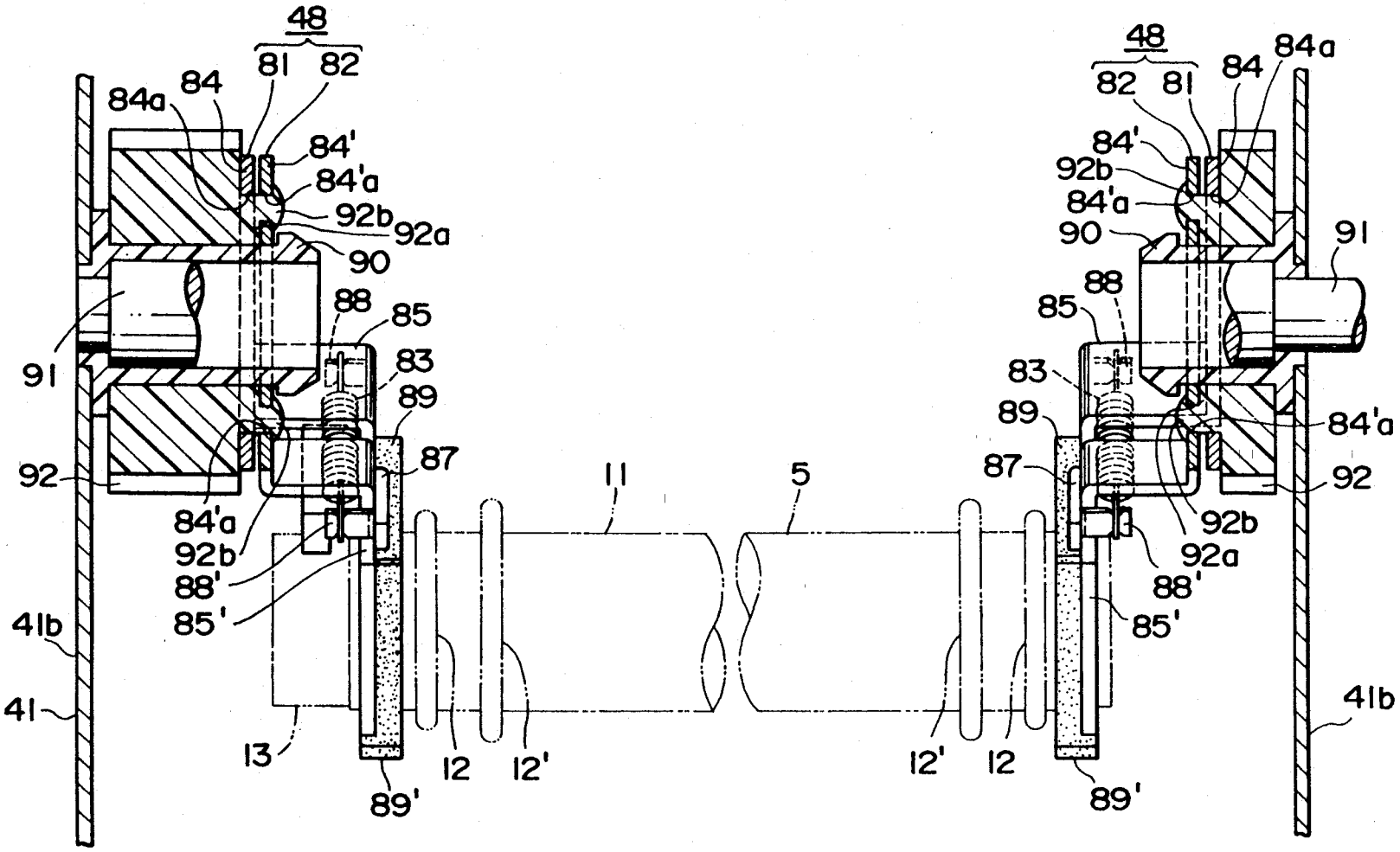
FIG. 7 is an enlarged sectional view taken along line VII—VII of FIG. 3.

Referring now to FIGS. 7 to 9, the locking lever 50 is bent in a substantially L-shaped profile as viewed from the left and has a cylindrical portion 50*a* formed at a mid portion thereof such that an axis thereof extends in the leftward and rightward direction. The locking lever 50 further has an engaging pawl 50*b* formed at an end portion thereof.

A supporting pin 93 is provided on the first pivotal element 81 of the left-hand side chucking lever 48. The supporting pin 93 extends leftwardly from a portion adjacent a base end of the arm 85 of the first pivotal element 81, and the locking lever 50 is fitted at the cylindrical portion 50*a* thereof for pivotal motion around the supporting pin 93.

It is to be noted that the other end portion 50*c* of the locking lever 50 is positioned between a pair of opposing front and rear end lugs 86*a* and 86*b* of the stopper portion 86 of the first pivotal element 81 with some spacing or spacings left therebetween.

A torsion coil spring 94 is fitted at a coiled portion 94*a* thereof around the cylindrical portion 50*a* of the locking lever 50, and an end portion of an arm 94*b* of the torsion coil spring 94 is resiliently contacted with the spring anchor 88 of the first pivotal element 91 while an end portion of the other arm 94*c* of the torsion coil spring 94 is resiliently contacted with a portion adjacent an end of the locking lever 50. The locking lever 50 is thus normally urged in the clockwise direction as viewed from the left by the torsion coil spring 94, and when the locking lever 50 is not externally pushed in the counterclockwise direction, it is normally held at its locking position wherein the other end portion 50*c* thereof contacts with and is stopped by the lug 86*a* of the stopper portion 86 of the first pivotal element 81 which is positioned rearwardly of the other lug 86*b* when the chucking levers 48 are at their standby position. Thus, the lug 86*a* will be hereinafter referred to as rear stopper while the other lug 86*b* will be hereinafter referred to as front stopper.

Referring now to FIGS. 1 to 5 and 9(A) to 9(D), a rotary shaft 95 is supported at the opposite end portions thereof for rotation on the supporting walls 41*b* of the supporting frame 41, and a pair of drive gears 96 are secured to the rotary shaft 95 adjacent the opposite ends while an input gear 97 is secured to a right end portion of the rotary shaft 95. The drive gears 96 are individually held in meshing engagement with the lever pivoting gears 92.

A worm 99 is connected to a rotary shaft of an ink ribbon loading motor 98 and operatively coupled to the input gear 97 by way of a worm wheel 100. Accordingly, when the motor 98 rotates, the drive gears 96 are rotated so that the lever pivoting gears 92 are rotated in a synchronized relationship with each other.

It is to be noted that, when the supply spool 5 is to be fed to the loaded position, the motor 98 is rotated forwardly in a direction to rotate the lever pivoting gears 92 in the clockwise direction as viewed from the left, but when the supply spool 5 is to be returned into its ink ribbon and photographic paper cartridge 2, the motor 98 is rotated reversely in the opposite direction to rotate the lever pivoting gears 92 in the counterclockwise direction.

A pair of lever stoppers 101 each in the form of a flat plate extend inwardly toward each other from the supporting walls 41*b* of the supporting frame 41 while a stopper pin 102 is provided on and extends rightwardly from the left-hand side supporting wall 41*b*. A back tension gear 103 is supported for rotation on a shaft which is provided on and extends rightwardly from the left-hand side wall 41*b*. A friction plate 104 is held in contact with a side face of the back tension gear 103 under an urging force of a compression spring 105 so that a suitable load may be applied to the back tension gear 103.

Figure 9A:
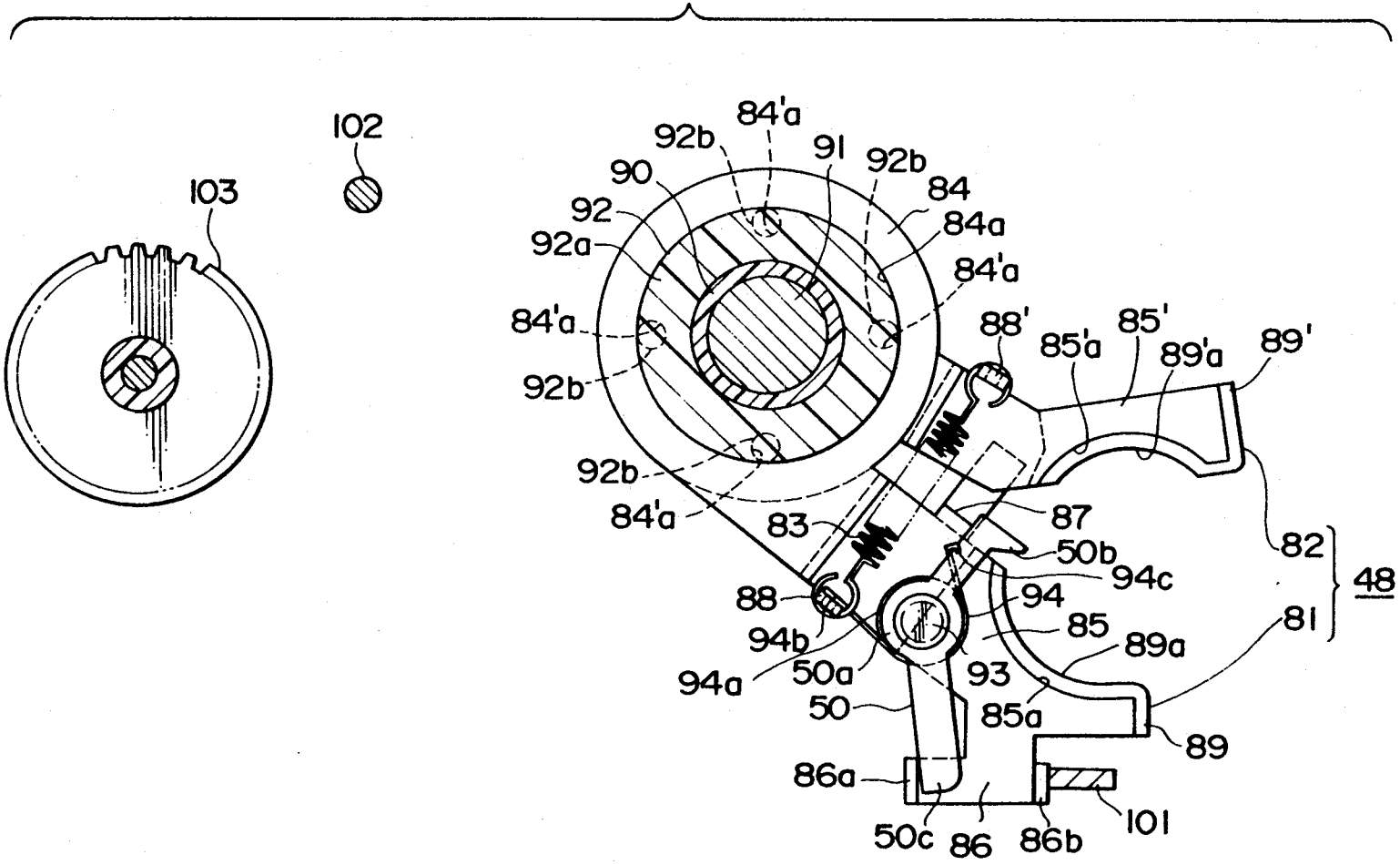
FIGS. 9(A) to 9(D) are enlarged side elevational views, partly broken, showing different successive stages of a feeding operation of a spool by the spool feeding means shown in FIG. 8.

Referring now to FIGS. 3 to 5, 7 and 9(A) to 9(D), the chucking levers 48 are normally held at the individual standby positions in a condition wherein the first and second pivotal elements 81 and 82 are in a somewhat open condition as seen in FIG. 9(A). In particular, in this condition, the first pivotal elements 81 are held in a posture wherein the spool holding portions 89*a* thereof are directed obliquely upwardly forwards while the second pivotal elements 83 are held in a posture wherein the spool holding portions 89'*a* thereof are directed obliquely downwardly forwards. Holding of the first pivotal elements 81 in the posture described above is achieved by the stopper portions 86 thereof which are contacted from the rear with the lever stoppers 101 to prevent the first pivotal elements 81 from being further pivoted in the counterclockwise direction as viewed from the left while holding of the second pivotal elements 82 in the posture described above is achieved by stopping of the lever pivoting gears 92 at respective defined positions.

Figure 9B:
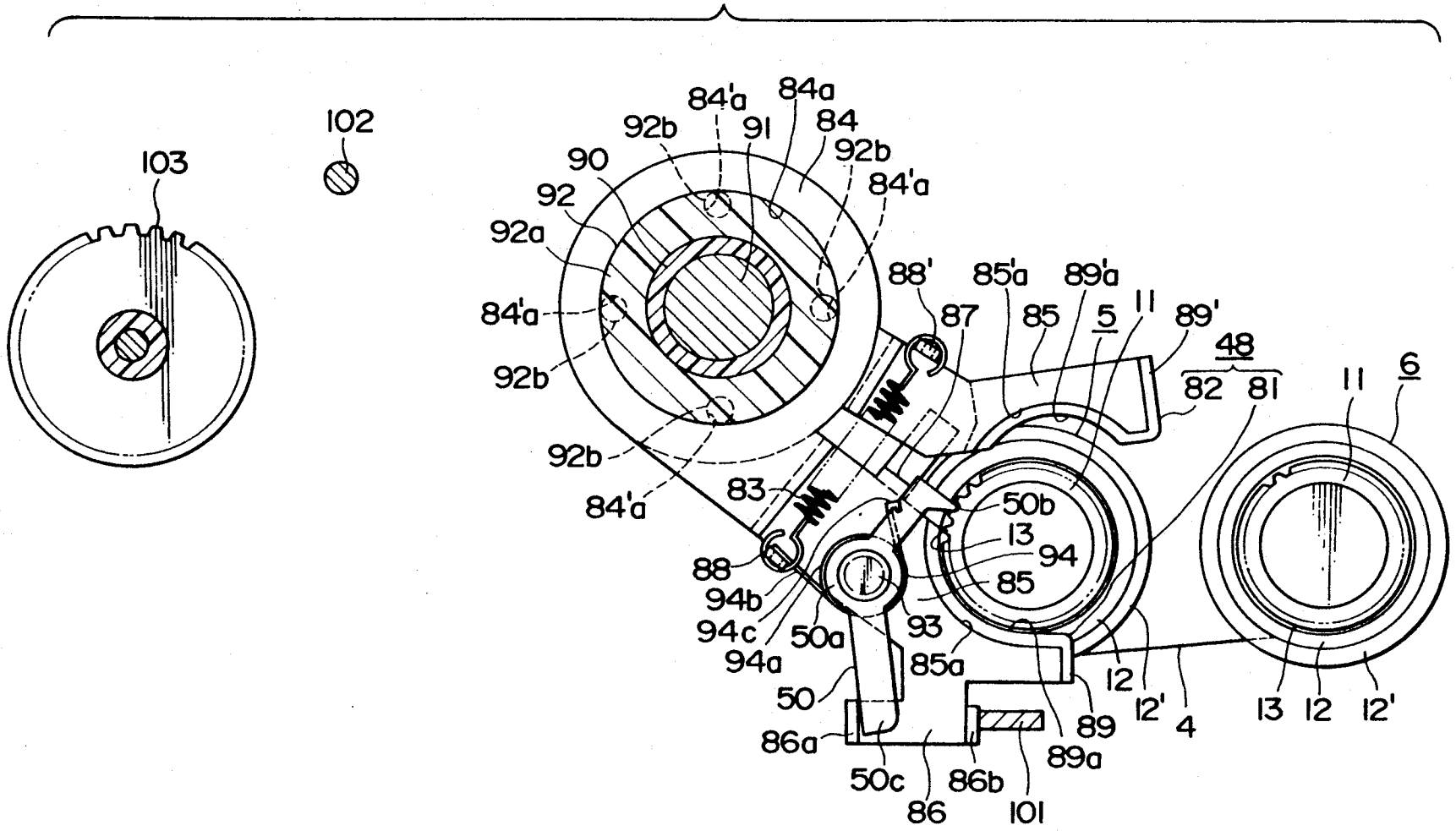

If an ink ribbon and photographic paper cartridge 2 is loaded into the mounted position in this condition, portions of the cylindrical portion 11 of the supply spool 5 outside the outer flanges 12 are positioned between the spool holding portions 89*a* and 89'*a* as seen in FIGS. 7 and 9(B).

Then, when it is detected that the ink ribbon and photographic paper cartridge 2 has been mounted to the mounted position, the motor 98 is rotated forwardly so that the lever pivoting gears 92 are rotated in the clockwise direction.

Figure 9C:
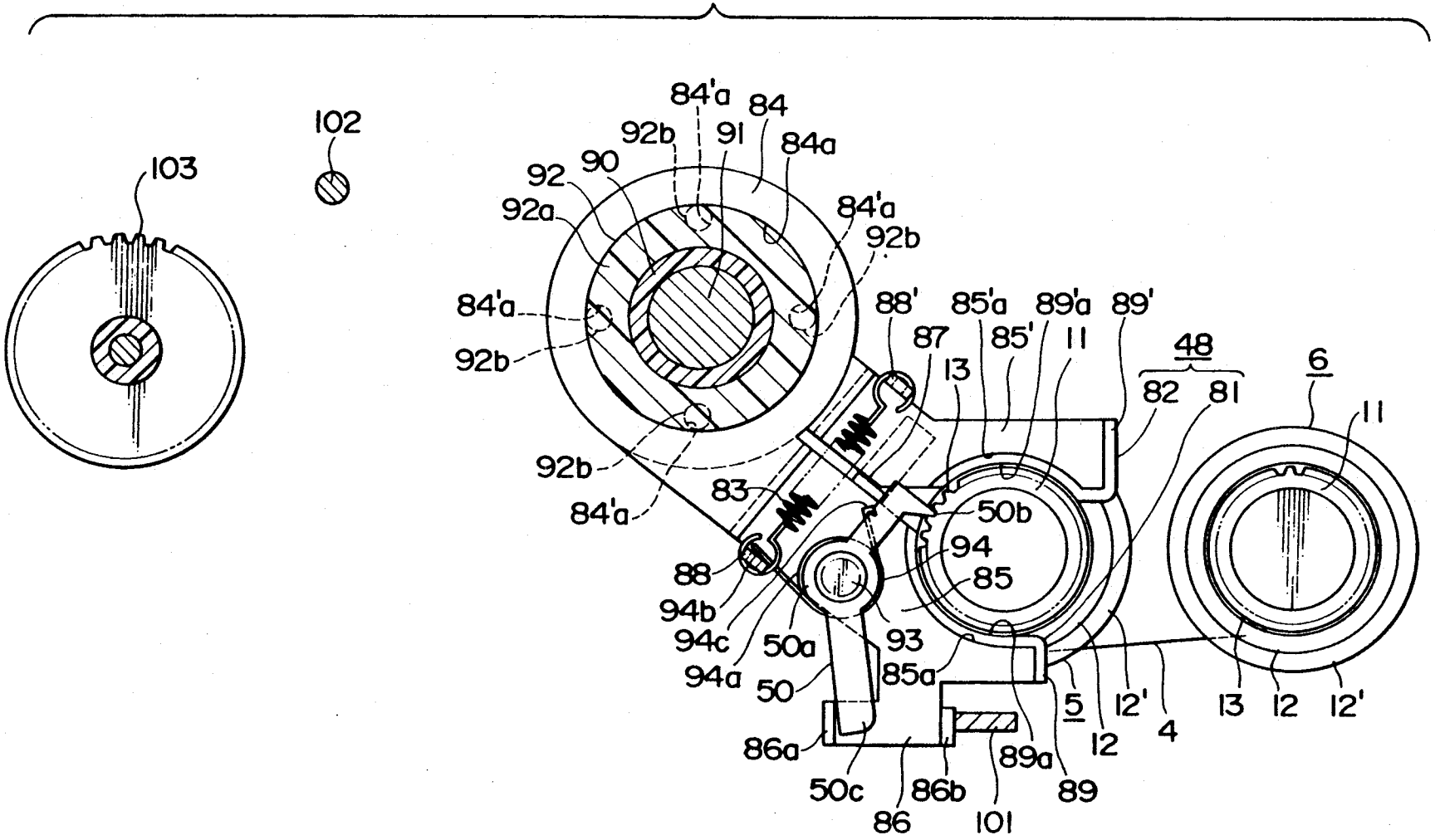

Thereupon, only the second pivotal elements 82 are first pivoted integrally with the lever pivoting gears 92 until side edges of the arms 85' thereof are contacted with the abutting lugs 87 of the first pivotal elements 81 as seen in FIG. 9(C). Consequently, the chucking levers 48 are closed to grip the supply spool 5 therein. It is to be noted that, in this condition, the supply spool 5 is supported for rotation between the spool holding portions 89*a* and 89'*a* of the chucking levers 48. From this condition, the pivotal elements 81 and 82 are pivoted integrally with each other, and after the chucking levers 48 move the supply spool 5 to the loading position shown in FIGS. 4 and 9(D) substantially opposite to the ink ribbon and photographic paper cartridge 2 with respect to the platen roller 51, rotation of the motor 98 is stopped.

It is to be noted that the opposite end portions of the bore 11*a* of the cylindrical portion 11 of the supply spool 5 are pressed against the outer peripheral faces of the tapered portions 33*a* of the spool holders 83 to push the spool holders 32 to yieldably retreat a little into the projected portions 16 of the cartridge case 7 to allow the supply spool 5 to be removed from the cartridge case 7, and the position of the supply spool 5 in its axial direction after removed from the cartridge case 7 is defined by the outer flanges 12 thereof opposing from the inner sides to the chucking levers 48. Accordingly, the supply spool 5 is held at a substantially same position in the leftward and rightward direction as that when it is held in the cartridge case 7.

Figure 9D:
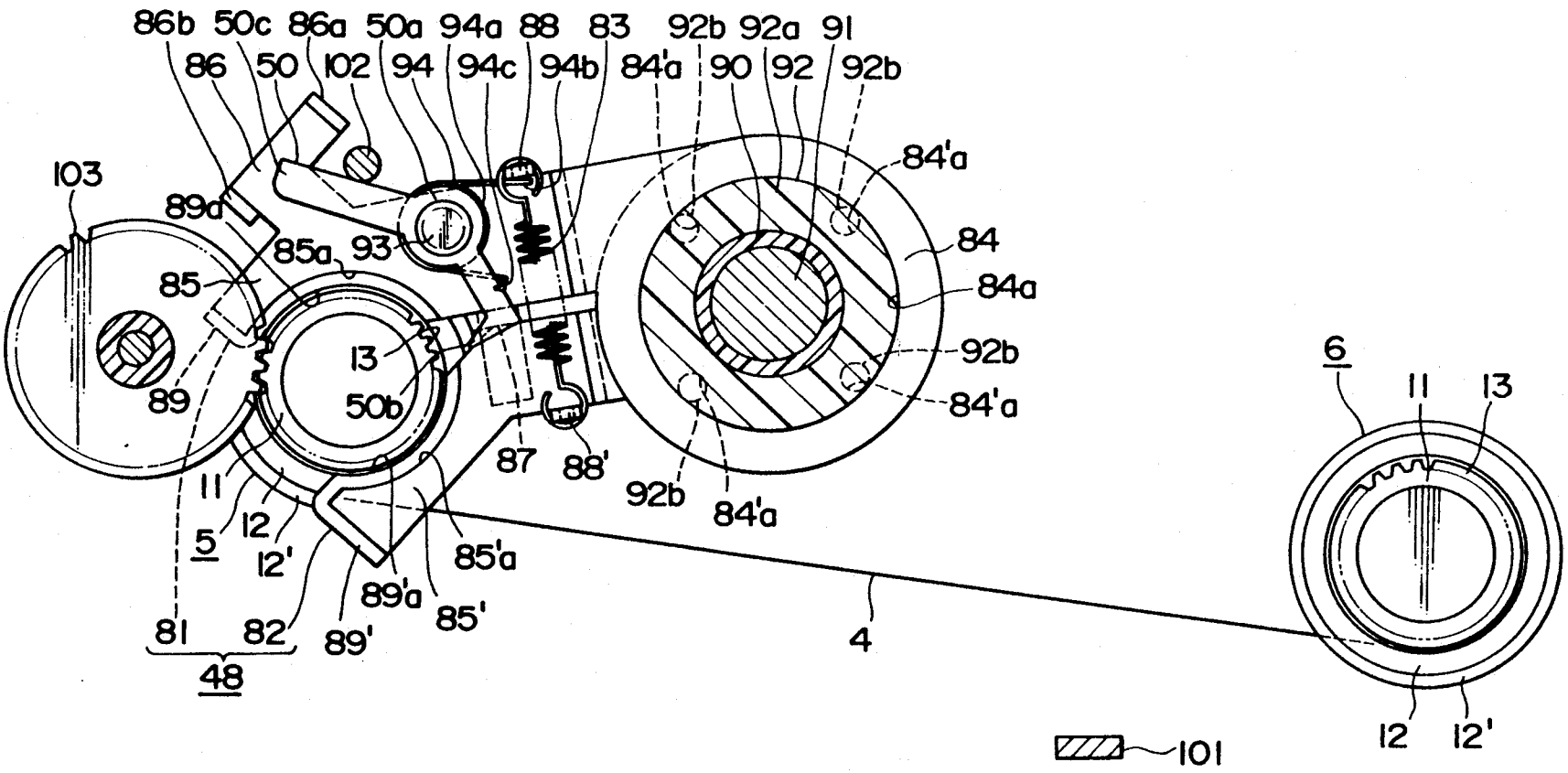
Figure 10:
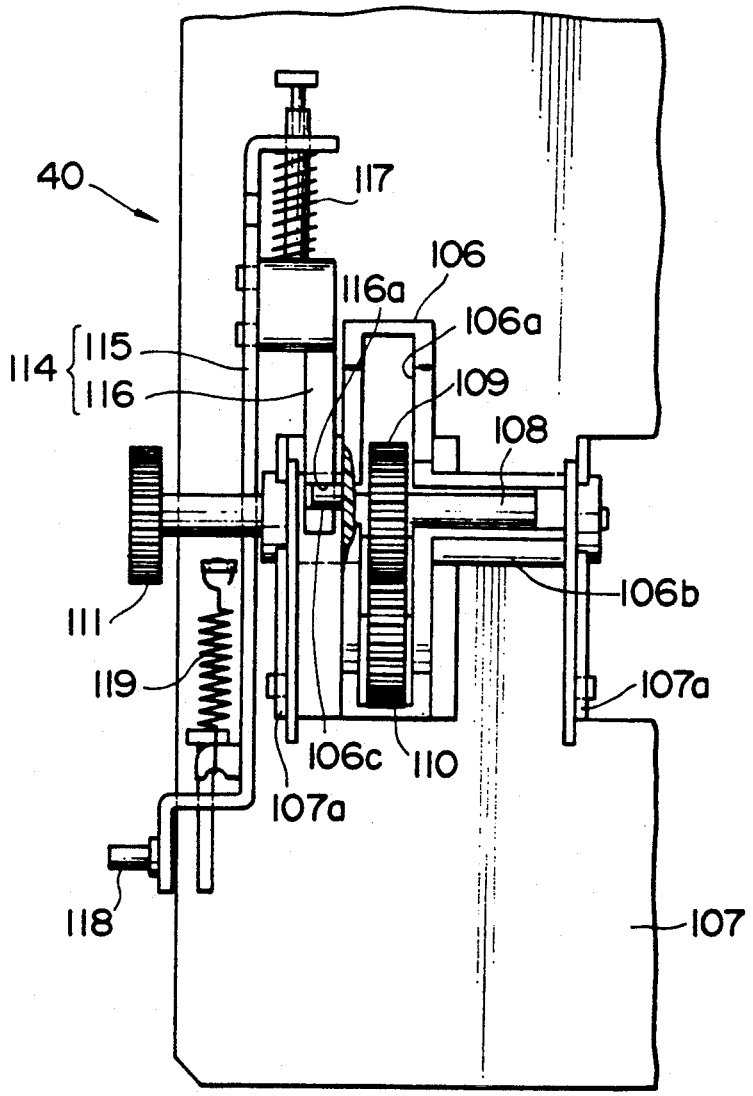
FIG. 10 is an enlarged partial plan view showing an ink ribbon feeding mechanism of the video printer of FIG. 1.
Figure 11:
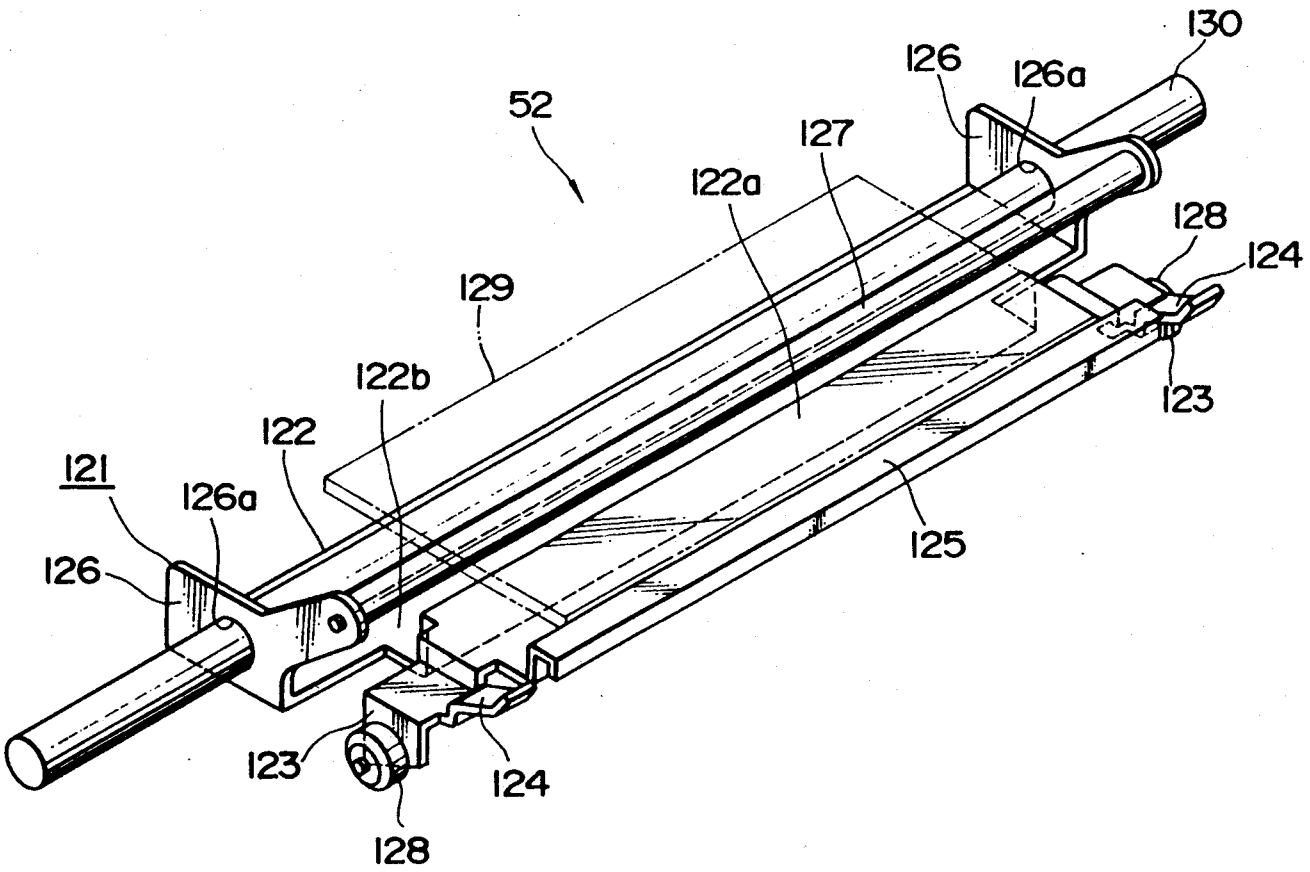
FIG. 11 is a schematic perspective view of a print head of the video printer of FIG. 1.

Then, while the supply spool 5 is being fed toward the loaded position, it is prevented from rotation. In particular, when the ink ribbon and photographic paper cartridge 2 is moved to the mounted position, the pawl 50*b* of the locking lever 50 is engaged with the gear portion 13 of the supply spool 5 as seen in FIG. 9(B) to prevent further rotation of the supply spool 5, and the supply spool 5 is taken out from the cartridge case 7 while it is held stopped from rotation in this manner. Then, when the chucking levers 48 come to a position immediately before the loaded position, a portion of the locking lever 50 adjacent the end portion 50*c* is contacted with and relatively pushed by the stopper pin 102 thereby to pivot the locking lever 50 a little in the counterclockwise direction to move the pawl 50*b* thereof away from the gear portion 13 of the supply spool 5 as seen in FIG. 9(D).

Further, when the supply spool 5 reaches the loaded position, the gear portion 13 thereof is brought into meshing engagement with the back tension gear 103, and consequently, a suitable load is applied to the supply spool 5 by the back tension gear 103.

Feeding of the supply spool 5 to the loaded position proceeds in such a manner as described above.

Thus, since the supply spool 5 is fed to the loaded position while it is held stopped from rotation, the ink ribbon 4 is drawn out from the supply spool 6. The thus drawn out ink ribbon 4 passes below the platen roller 51, and a portion of the ink ribbon 4 thus drawn out from the supply spool 6 is only such leader portion as described above or an already used portion. Accordingly, an unused portion of the ink ribbon 4 will not be drawn out from the supply spool 6.

It is to be noted that the ink ribbon 4 drawn out in this manner is acted upon by suitable tension as a load is applied to the take-up spool 6 by the ink ribbon feeding mechanism 40, and accordingly, it can be drawn out without a slack.

The position described above is a home position of the video printer 1.

If an ink ribbon unloading instruction is received in the home position of the video printer 1, the motor 98 is rotated reversely so that the lever pivoting gears 92 are rotated in the counterclockwise direction. Consequently, the gear portion 13 of the supply spool 5 is first moved away from the back tension gear 103 while the stopper pin 102 is spaced relatively away from the locking lever 50. Consequently, the locking lever 50 is returned to its locking position by the urging force of the torsion spring 95 to bring the pawl 50*b* thereof into engagement with the gear portion 13 of the supply spool 5 to inhibit rotation of the supply spool 5. Then, when the chucking levers 48 come to a position immediately before the standby position, the opposite end portions of the cylindrical portion 11 of the supply spool 5 are fitted onto the holding portions 33 of the spool holders 32, thereby returning the supply spool 5 into the cartridge case 7. Immediately after then, the stopper portions 86 of the first pivotal elements 81 are contacted with the lever stoppers 101 so that the chucking levers 48 are put into an open condition and come to the standby position.

Consequently, the supply spool 5 is enabled to be removed from the chucking levers 48.

Referring now to FIGS. 1, 2, 6 and 10, the ink ribbon feeding mechanism 40 includes a seesaw lever 106 on which a take-up gear 110 for rotating the take-up spool 6 is supported, a sliding lever 114 for pivoting the seesaw lever 106, an intermediate lever 120 which is pushed at a predetermined timing by the pivotal lever 64 to advance the sliding lever 114, and a driving system 113 for rotating the take-up gear 110.

The seesaw lever 106 has an inverted L-shaped profile as viewed from a side and has an upwardly open recessed portion 106*a* formed thereon. The seesaw lever 106 has a substantially cylindrical hub portion 106*b* formed at a mid portion thereof in the forward and backward direction such that it extends in the opposite leftward and rightward directions. A rotary shaft 108 extends through the hub portion 106*b* of the seesaw lever 106 and is supported for rotation on a pair of supporting pieces 107*a* provided uprightly on a gear base 107 mounted on the bottom plate 41*a* of the supporting frame 41. Thus, the seesaw lever 106 is supported for pivotal motion on the supporting pieces 107*a*. An intermediate gear 109 is secured to the rotary shaft 108 and positioned in the recessed portion 106*a* of the seesaw lever 106. The take-up gear 110 is supported for rotation at a front end portion of the seesaw lever 106 such that it partially projects from a front end and an upper end of the seesaw lever 106. The take-up gear 110 is held in meshing engagement with the intermediate gear 109. An input gear 111 is secured to a left end portion of the rotary shaft 108 and connected to be rotated by the driving system 113 which includes a motor 112. Thus, when the motor 112 rotates, the rotary shaft 108 and the intermediate gear 109 are rotated, and consequently, the take-up gear 110 is rotated.

It is to be noted that the take-up gear 110 is normally rotated in the clockwise direction as viewed from the left, and a torque limiter making use of friction is interposed in the driving system 113.

The sliding lever 114 includes a main lever 115 supported for sliding movement in the forward and rearward directions at a left end portion of an upper face of the gear base 107, a sub lever 116 supported on the main lever 115 for sliding movement within a fixed range in the forward and rearward directions, a limiter spring 117 held in a compressed condition between rear end portions of the main lever 115 and the sub lever 116, and a connecting pin 118 extending leftwardly from a front end portion of the main lever 115. A recess 116*a* is formed on an upper face of a front end portion of the sub lever 116, and an engaging projection 106*c* extends leftwardly from a location of the seesaw lever 106 forwardly of the center of pivotal motion and is held in sliding engagement in the recess 116*a*.

A tension spring 119 extends between the main lever 115 and the gear base 107 so that the main lever 115 is normally urged in the rearward direction. When the main lever 115 is not externally pushed forwardly, the sliding lever 114 is held at a retracted position at a rear end of the range of movement thereof, and in this condition, the seesaw lever 106 is held at its standby position wherein the take-up gear 110 thereon is positioned a little below a locus of movement of the gear portion 13 of the take-up spool 6 of the ink ribbon and photographic paper cartridge 2 inserted in position in the cartridge holder 42.

When the ink ribbon and photographic paper cartridge 2 is moved to the mounted position, part of the take-up gear 110 is relatively advanced into the spool accommodating chamber 20 through the recess 54*b* of the cartridge holder 42 and the gear insertion recess 25 of the cartridge case 27 to a position at which it is opposed substantially from below to the gear portion 13 of the take-up spool 6.

The intermediate lever 120 has a substantially L-shaped profile as viewed from the left and is supported at an intermediate portion thereof for pivotal motion on the left-hand side supporting wall 41*b*. An elongated hole 120*a* is formed at a lower end portion of the intermediate lever 120, and the connecting pin 118 on the main lever 115 is held in sliding engagement in the elongated hole 120*a*.

Thus, while the pivotal lever 64 is pivoted from a position at which the cartridge holder 42 reaches the mounted position to another position at which the cartridge holder 42 is resiliently held at the mounted position, an end portion of the arm 66 thereof pushes an upper end portion of the intermediate lever 120 to pivot the intermediate lever 120 in the counterclockwise direction as viewed from the left as seen in FIG. 6. Consequently, the sliding lever 114 is advanced so that the engaging projection 106*b* of the seesaw lever 106 is pushed substantially forwardly to pivot the seesaw lever 106 in the counterclockwise direction until the take-up gear 110 is brought into meshing engagement with the gear portion 13 of the take-up spool 6.

After then, the take-up gear 110 is resiliently pressed against the gear portion 13 of the take-up spool 5 by the limiter spring 117.

Although feeding of the supply spool 5 to the loaded position described above is performed from the condition wherein the take-up spool 6 remains in meshing engagement with the take-up gear 110, the take-up spool 6 is rotated in accordance with drawing out of the ink ribbon 4 due to the presence of the torque limiter interposed in the driving system 113, but also a load of the driving system 113 is applied to the take-up spool 6. Accordingly, suitable tension is applied to the ink ribbon 4 being drawn out from the take-up spool 6.

Thus, if the motor 112 is rotated from the condition wherein the take-up gear 110 meshes with the gear portion 13 of the take-up spool 6, then the take-up spool 6 is rotated in the counterclockwise direction as viewed from the left, that is, in a direction to wound the ink ribbon 4.

It is to be noted that, when a printing instruction is received or an ejecting instruction to eject an ink ribbon and photographic paper cartridge 2 is received, the motor 112 is energized to rotate the take-up spool 6 so that, upon printing, the ink ribbon 4 is drawn out from the supply spool 5 and wound onto the take-up spool 6, but at an initial stage of an ejecting operation, that is, when the supply spool 5 is to be returned into the cartridge case 7, a portion of the ink ribbon 4 between the supply spool 5 and the take-up spool 6 is wound onto the take-up spool 6.

When the cartridge holder 42 is moved toward the ejecting position, pressing of the pivotal lever 64 against the intermediate lever 120 is cancelled, and consequently, the sliding lever 114 is returned to the retracted position by the urging force of the tension spring 119 so that the seesaw lever 106 is returned to the standby position.

Referring to FIGS. 1 to 5, 11 and 12, paper clamping means not shown is provided on an outer peripheral face of the platen roller 51. Thus, a photographic paper sheet 3 forwarded from the ink ribbon and photographic paper cartridge 2 by the paper supplying mechanism 38 is clamped at an end portion thereof by the paper clamping means. Then, when the platen roller 51 is rotated in this condition in the counterclockwise direction as viewed from the left, the photographic paper sheet 3 is wrapped around the outer peripheral face of the platen roller 51.

The print head 52 includes a movable base 121 formed as a unitary member from a metal plate, and a ribbon guide 127, a circuit board 129 and so forth supported on the movable base 121.

The movable base 121 has a main portion 122 having a substantially rectangular shape elongated in the leftward and rightward direction as viewed from above. A front half portion 122*a* of the main portion 122 is located a little upwardly of the other rear half portion 122*b*, and a pair of roller supporting lugs 123 extend downwardly from the opposite left and right ends of the front half portion 122*a*. Further, a pair of comparatively small pressure receiving lugs 124 extend substantially upwardly from the opposite left and right ends of a front edge of the front half portion 122*a*, and a leftwardly and rightwardly elongated guide portion 125 extends upwardly from a portion of the front edge of the front half portion 122*a* between the pressure receiving lugs 124. Meanwhile, a pair of side pieces 126 extend upwardly from the opposite left and right ends of the rear half portion 122*b*. The pressure receiving lugs 124 are curved, except end portions thereof, such that they may present a substantially arcuate profile as viewed from a side. The guide portion 125 is formed such that it may present a downwardly open channel-shaped profile as viewed from a side.

The side pieces 126 are so shaped that front half portions thereof extend substantially obliquely upwardly forwards, and the ribbon guide 127 in the form of a thin round rod is supported at the opposite end portions thereof for rotation at front end portions of the side pieces 126 of the movable base 121. Each of the side pieces 126 has a fitting hole 126*a* formed at a substantially central portion thereof.

A roller 128 is supported for rotation on each of the roller supporting lugs 123 of the movable base 121.

The circuit board 129 is secured to the movable base 121 in an opposing, parallel relationship above the main portion 122 of the movable base 121. A leftwardly and rightwardly extending head element not shown is mounted at a front end portion of an upper face of the circuit board 129 and has a large number of heat generating elements disposed thereon in a line in the leftward and rightward direction.

The head moving means 53 includes a moving shaft 130 supported for movement in the forward and rearward directions on the supporting walls 41*b* of the supporting frame 41, and a pair of head moving levers 132 for moving the moving shaft 130 to move the print head 52 in the forward or rearward direction.

The moving shaft 130 is in the form of a rod elongated in the leftward and rightward direction and is held at the opposite end portions thereof in sliding engagement in a pair of elongated holes 131 formed at rear end portions adjacent lower ends of the supporting walls 41*b* of the supporting frame 41 such that they extend horizontally in the forward and rearward direction.

The head moving levers 132 are supported for pivotal motion on the supporting walls 41*b* of the supporting frame 41 and each includes a base portion 133 in the form of a disk and an arm 134 extending in a radially outward direction from an outer periphery of the base portion 133. A gear portion 133*a* is formed on the outer periphery of the base portion 133 of each of the head moving levers 132. A longitudinally elongated hole 134*a* is formed in the arm 134 of each of the head moving levers 132, and portions of the moving shaft 130 adjacent the opposite ends are held in sliding engagement in the elongated holes 134*a* of the head moving levers 132.

A rotary shaft 135 extends between and is supported for rotation at upper ends of rear end portions of the supporting walls 41*b* of the supporting frame 41. A pair of gears 136 are secured to portions adjacent the opposite ends of the rotary shaft 135 and individually held in meshing engagement with the gear portions 133*a* of the head moving levers 132.

It is to be noted that the rotary shaft 135 is rotated by a driving system not shown, and when the rotary shaft 135 is rotated, the head moving levers 132 are pivoted in a synchronized relationship with each other to push the moving shaft 130 to move in the forward or rearward direction.

The moving shaft 130 extends through the fitting holes 126*a* formed in the movable base 121 of the print head 52, and while the print head 52 is not pushed upwardly, the rollers 128 of the print head 52 remain placed for rolling movement on an upper face of the bottom plate 41*a* of the supporting frame 41.

Accordingly, the print head 52 is supported for movement in the forward and rearward directions on the supporting frame 41 and also for pivotal motion around an axis of the moving shaft 130 by means of the moving shaft 130 and the rollers 128, and it is moved forwardly or rearwardly when the head moving levers 132 are pivoted. Such movement of the print head 52 takes place between the retracted position mentioned hereinabove at which it is spaced substantially obliquely rearwardly downwards from the platen roller 51 to provide therebetween a spacing of a distance sufficient to allow feeding of the supply spool 5 through the spacing and another advanced position at which a front end portion of the print head 52 is opposed to the platen roller 51 substantially from just below.

A contacting mechanism 137 is provided for contacting the printing head 52 with the platen roller 51 with the ink ribbon 4 and a photographic paper sheet 3 interposed therebetween, and includes a pushing up shaft 139 supported for displacement substantially in the upward and downward directions, and a pair of sliders 140 for moving the pushing up shaft 139.

A guide slot 138 is formed in each of the supporting walls 41*b* of the supporting frame 41 such that it extends substantially in the upward and downward direction in an arc centered at the moving shaft 130 forwardly of the moving shaft 130 in a condition wherein the print head 52 is at the advanced position.

The pushing up shaft 139 is in the form of a rod elongated in the leftward and rightward direction, and portions adjacent the opposite ends of the pushing up shaft 139 are held in sliding engagement in the guide slots 138 of the supporting walls 41*b* of the supporting frame 41.

Each of the sliders 140 is in the form of a plate elongated in the forward and rearward direction and has a pair of guide slots 141 formed at the opposite upper and lower end portions thereof such that they extend in the forward and rearward direction. A pair of guide pins 142 are provided to extend outwardly from each of the supporting walls 41*b* of the supporting frame 41 and are held in sliding engagement in the guide slots 141 of the corresponding slider 140 to support the slider 140 for movement in the forward and rearward directions on the support wall 41*b*.

Each of the sliders 140 has a cam slot 143 formed at a front half portion thereof such that a front end portion 143*a* and a rear half portion 143*b* (hereinafter referred to as holding portion) extend horizontally in the forward and rearward direction while an intermediate portion 143*c* (hereinafter referred to as displacing portion) between the front end portion 143*a* and the holding portion 143*b* is inclined rearwardly upwardly.

A rack plate 144 is secured to each of the sliders 140, and pinion gears of a driving system not shown are individually held in meshing engagement with rack portions 144*a* of the rack plates 144. Accordingly, when the rack portions 144*a* are fed by the pinion gears, the sliders 140 are moved in the forward or rearward direction.

The opposite end portions of the pushing up shaft 139 are held in sliding engagement in the cam slots 143 of the sliders 140.

In the initial condition described above of the video printer 1, the print head 52 is held at its retracted position in a forwardly downwardly inclined posture as seen in FIG. 3 while the sliders 140 are held at a position of the rear end of the range of movement thereof. In this condition, the pushing up shaft 139 is in engagement at the opposite end portions thereof with the front end portions 143*a* of the cam slots 143 of the sliders 140 and accordingly is at the lower end of the range of movement thereof so that it is held at the same height as the pressure receiving lugs 124 of the moving base 121 of the print head 52.

Such condition is maintained until after feeding of the supply spool 5 to the loaded position is completed.

Figure 12:
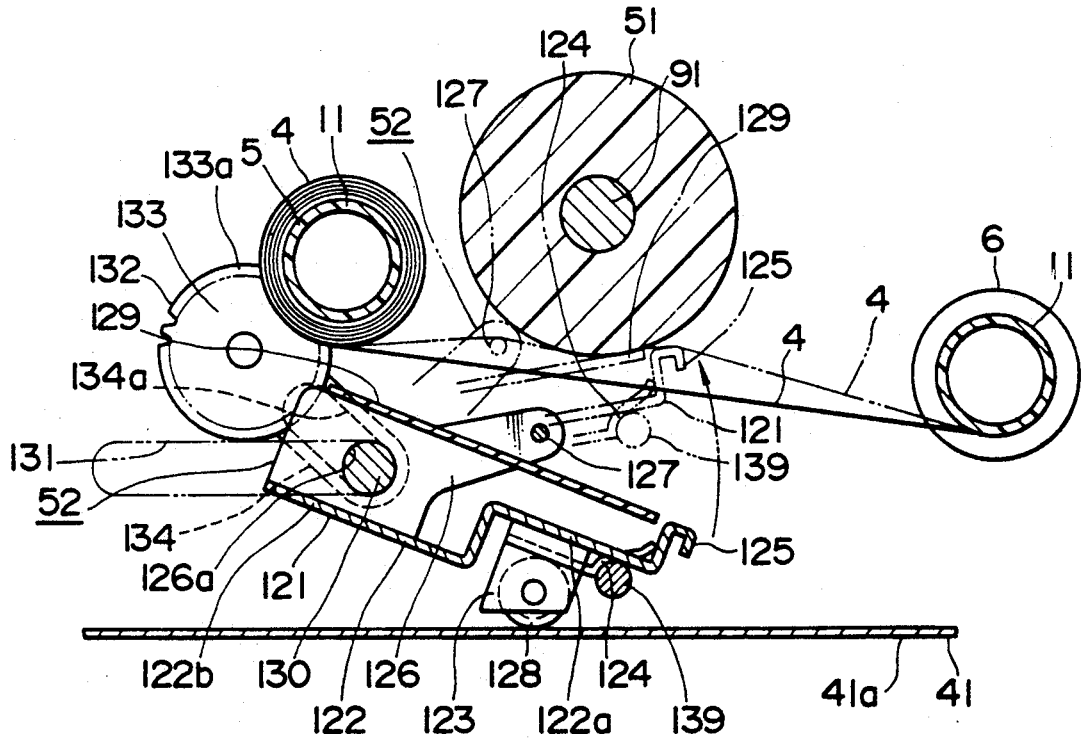
FIG. 12 is a sectional view taken along line XII—XII of FIG. 1 showing the print head at an advanced position.

Then, if a printing instruction is received, then the print head 52 is first moved to the advanced position as indicated by a solid line in FIG. 12 so that arcuately curved portions of the pressure receiving lugs 124 thereof are contacted from rearwardly above with the pushing up shaft 139, and then the sliders 140 are moved forwardly. Consequently, the displacing portions 143*c* of the cam slots 143 of the sliders 140 push the opposite end portions of the pushing up shaft 139 forwardly upwardly so that the pushing up shaft 139 is displaced upwardly to push the pressure receiving lugs 124 of the print head 52 upwardly. Consequently, the print head 52 is pivoted in the counterclockwise direction as viewed from the left so that the head element not shown is moved to its contacting position at which it contacts substantially from below with the platen roller 51. Then, such condition is maintained as the height of the pushing up shaft 139 is held by the holding portions 143*b* of the cam slots 143 of the sliders 140. It is to be noted that, though not shown in the drawings, suitable limiters are interposed between the head element and the sliders 140.

It is to be noted that, if an instruction to end printing, the sliders 104 are first retracted, whereupon the print head 52 is pivoted downwardly by its own weight. Then, the head moving levers 132 are pivoted rearwardly to push the moving shaft 130 rearwardly so that the print head 52 is returned to its retracted position. In this condition, the supply spool 5 is returned into the ink ribbon and photographic paper cartridge 2.

If a printing instruction is received in a condition of the home position of the video printer 1 after completion of loading of the ink ribbon 4, a photographic paper sheet 3 is drawn out from the ink ribbon and photographic paper cartridge 2 and wrapped around the platen roller 51. Then, the print head 52 is moved to the pressed position so that the head element thereon is pressed against the platen roller 51 with the ink ribbon 4 and the photographic paper sheet 3 interposed therebetween. In this condition, portions of the ink ribbon 4 forwardly and rearwardly on the opposite sides of the print head 52 are individually contacted with the ribbon guide 127 and the guide portion 125 of the print head 52.

Then, from such condition, the ink ribbon 4 is drawn out from the supply spool 5 and the platen roller 51 is rotated while phase matching of the ink layers 10 of the ink ribbon 4 with the photographic paper 3 is performed. Meanwhile, the ink ribbon 4 is fed in a synchronized relationship with rotation of the platen roller 51. Consequently, ink of an ink layer 10 is transferred in a print pattern of a picture image to the print face of the photographic paper sheet 3. Such transfer is performed successively for the ink layers for the three types described hereinabove to obtain a print of the full colors.

Having now fully described the invention, it will be apparent to one of ordinary skill in the art that many changes and modifications can be made thereto without departing from the spirit and scope of the invention as set forth herein. For example, movement of the print head and contacting of the print head against the platen roller may otherwise be performed by single means, or a spool to be fed for loading of transfer paper may alternatively be the take-up spool. Further, the present invention can be applied not only to such a recording apparatus for a video printer as described above but also recording apparatus of various types wherein transfer paper and record paper are used to effect recording.

What is claimed is:

1. A recording apparatus, comprising:

a platen roller;

means for mounting in position into said recording apparatus a transfer paper and record paper cartridge which includes a record paper accommodating section in which record paper sheets are accommodated and a transfer paper accommodating section in which a supply spool around which transfer paper is wound and a take-up spool to which a leading end of the transfer paper is secured are accommodated;

spool feeding means for taking out one of said supply spool and said take-up spool from the transfer paper and record paper cartridge mounted in position in said recording apparatus and feeding the one spool to an operative position substantially opposite to the transfer paper and record paper cartridge with respect to said platen roller to effect loading of the transfer paper so that a portion of the transfer paper which extends between the one spool and the other spool may be opposed to said platen;

paper supply means for taking out one of the record paper sheets from within the transfer paper and record paper cartridge and feeding the record paper sheet to said platen roller;

a print head for being pressed against said platen roller with the record paper sheet and the transfer paper interposed therebetween;

head moving means for holding, when loading of the transfer paper is performed by said spool loading means, said print head at a first position at which said print head is spaced from said platen roller by a distance sufficient to allow the one spool to pass through the spacing to or from the operative position, and for moving, after such loading of the transfer paper is completed, said print head along a linear path from said first position to a second position at which said print head is opposed to said platen roller so that it may be pressed against said platen roller; and contacting means for moving said print head from said second position toward said platen roller along an arcuate path and pressing said print head against said platen roller.

2. A recording apparatus according to claim 1, wherein the one spool is the supply spool.

3. A recording apparatus according to claim 1, wherein the one spool is positioned nearer to said platen roller than the other spool and the record paper sheets when the transfer paper and record paper cartridge is mounted in position.

4. A recording apparatus according to claim 3, wherein the one spool is exposed outside and removably supported on the transfer paper and record paper cartridge, and said spool feeding means is mounted for pivotal motion around an axis of said platen roller and adapted to receive the one spool from the transfer paper and record paper cartridge and feed the same to the operative position along an arcuate path centered at the axis of said platen roller.

5. A recording apparatus according to claim 4, wherein said spool feeding means includes a pair of means for removably gripping the opposite end portions of the one spool.

6. A recording apparatus according to claim 1, wherein said spool feeding means operates in response to mounting of the transfer paper and record paper cartridge in position into said recording apparatus to feed the one spool to the operative position.

7. A recording apparatus according to claim 1, further comprising means for preventing inadvertent rotation of the one spool around its axis while the one spool is fed between the transfer paper and record paper cartridge and the operative position.

8. A recording apparatus according to claim 1, wherein said head moving means includes supporting means for supporting said print head for pivotal motion around an axis thereon, means for defining a linear path along which said supporting means is moved, and means for driving said supporting means to move along the linear path thereby to move said print head between the first and second positions.

9. A recording apparatus according to claim 8, wherein said supporting means includes a shaft which is pushed at the opposite end portions thereof and moved perpendicularly to the axis thereof by said driving means.

10. A recording apparatus according to claim 8, wherein said contacting means includes a rod, means for guiding said rod in a perpendicular direction to an axis of said rod along an arcuate path centered at the axis of said supporting means when said print head is at the second position, and means for driving said rod to move along the arcuate path to push said print head to press against said platen.

11. A recording apparatus according to claim 1, wherein said spool feeding means feeds the one spool along a path which passes below said platen roller, and said print head is pressed against said platen roller from below.

* * * * *